US005924310A

United States Patent [19]

Conti

[11] Patent Number: 5,924,310

[45] Date of Patent: Jul. 20, 1999

[54] DEVICE FOR CLOSING ONE END OF A TUBULAR KNITTED ARTICLE ON THE SAME CIRCULAR MACHINE THAT PRODUCED IT

[75] Inventor: Paolo Conti, Florence, Italy

[73] Assignee: Golden Lady S.p.A., Ancona, Italy

[21] Appl. No.: 09/077,179

[22] PCT Filed: Nov. 22, 1996

[86] PCT No.: PCT/IT96/00218

§ 371 Date: May 21, 1998

§ 102(e) Date: May 21, 1998

[87] PCT Pub. No.: WO97/20089

PCT Pub. Date: Jun. 5, 1997

[30] Foreign Application Priority Data

Nov. 28, 1995 [IT] Italy ..... FI95A0245

[51] Int. Cl.[6] ..... D04B 9/56

[52] U.S. Cl. ..... 66/58; 66/148

[58] Field of Search ..... 66/148, 58, 11, 66/13, 43, 46, 48, 49

[56] References Cited

U.S. PATENT DOCUMENTS 5,570,591 11/1996 Frullini et al. ..... 66/58
5,617,744 4/1997 Conti ..... 66/58
5,647,229 7/1997 Conti ..... 66/58
5,727,400 3/1998 Lonati et al. ..... 66/58

FOREIGN PATENT DOCUMENTS 0 592 376 4/1994 European Pat. Off. .
1 346 516 11/1963 France .
16 35 992 7/1971 Germany .
WO95/31595 11/1995 WIPO .

*Primary Examiner*—John J. Calvert
*Assistant Examiner*—Larry D. Worrell, Jr.
*Attorney, Agent, or Firm*—McGlew and Tuttle, P.C.

[57] ABSTRACT

The device, which is combined with the needle (1A; 1B) cylinder and cooperates with a normal disc (5) that has hooks (7A, 7B), is located coaxially with the cylinder and can be raised axially; the hooks (7A) of one semicircle can be actuated to take stitch loops from one semicircle of needles (1A) for transfer to the opposite semicircle of needles (1B); a half ring (9), external to the needle (1A, 1B) cylinder, is hinged at both its ends about a diametrical axis (X—X) in the working area of the needles and in such a way that it can rotate through 180°; sliding in radial slots in the half ring are pick-up hooks (10) with closing sliders (12–12A) for engaging the initial loops of toe fabric formed by said needles (1A), which loops are transferred from hooks (7A); by rotating upwards, the half-ring (9) transfers these loops and brings them down over the needles (1B) of the opposite semicircle, so that the toe (P) fabric is engaged by said needles (1B) of the opposite semicircle.

14 Claims, 30 Drawing Sheets

FIG. 17
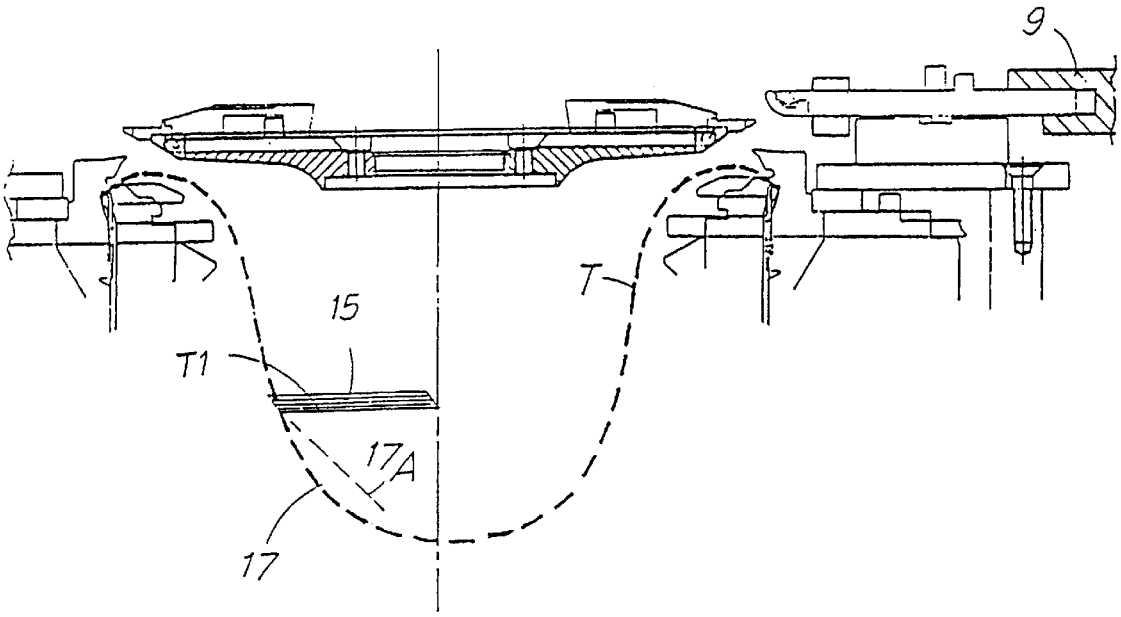
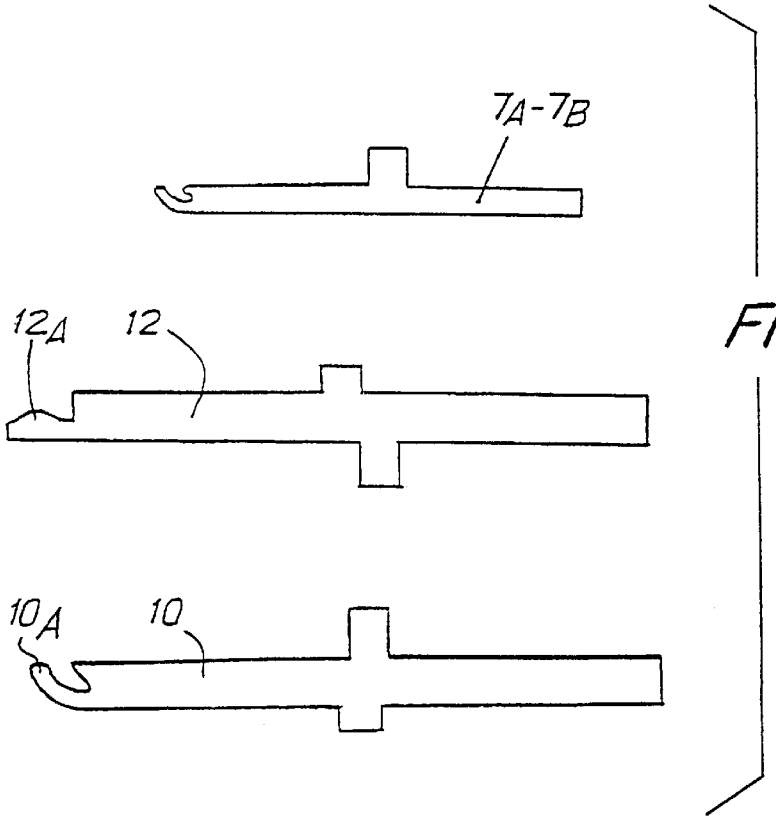
FIG. 18

DEVICE FOR CLOSING ONE END OF A TUBULAR KNITTED ARTICLE ON THE SAME CIRCULAR MACHINE THAT PRODUCED IT

FIELD OF THE INVENTION

The invention relates to a device for closing one end of a tubular knitted article on the same circular machine that produced it. The machine is equipped with a needle cylinder and with a mechanical means such as a normal disc having hooks and located coaxially with the cylinder. This device is simpler and more reliable than other known devices designed for the same purpose.

SUMMARY AND OBJECTS OF THE INVENTION

The present device comprises:

- a semicircle of hooks which can be actuated for the ordered taking of stitch loops from a first semicircle of needles, which stitch loops are intended to be transferred to the opposite semicircle of needles;
- a half ring, external to the needle cylinder, hinged at both of its ends about a diametrical axis in the working area of the needles and in such a way that it can rotate through 180°, rising and then falling;
- in radial slots in said half ring a semicircle of pick-up hooks with closing sliders for engaging the initial loops of toe fabric formed by said needles of the first semicircle; and
- means for controlling the hooks of the first semicircle and said pick-up hooks, and for moving the disc axially in such a way that the loops are passed from the hooks of the disc to the pick-up hooks, which transfer the loops they have received and bring them down over the needles of said opposite semicircle, which needles engage the toe fabric.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 7 to 17 show successive phases in the forming of the initial closure of the tubular article and the start of this tubular article;

FIG. 18 shows in detail some of the components involved in forming the closed toe;

DESCRIPTION OF THE PREFERRED EMBODIMENT

Figure 1:
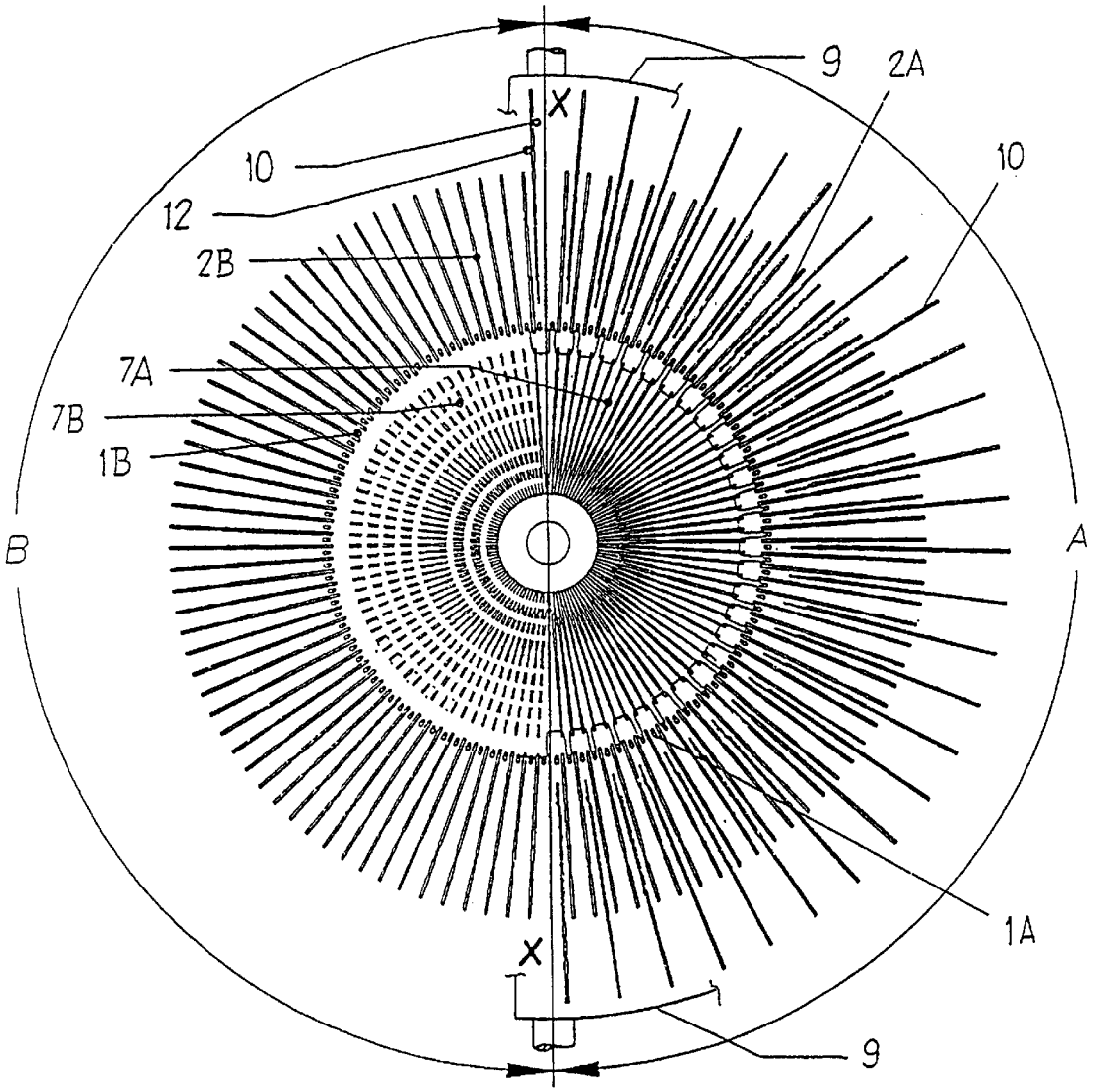
FIG. 1 shows a schematic plan view.
Figure 22:
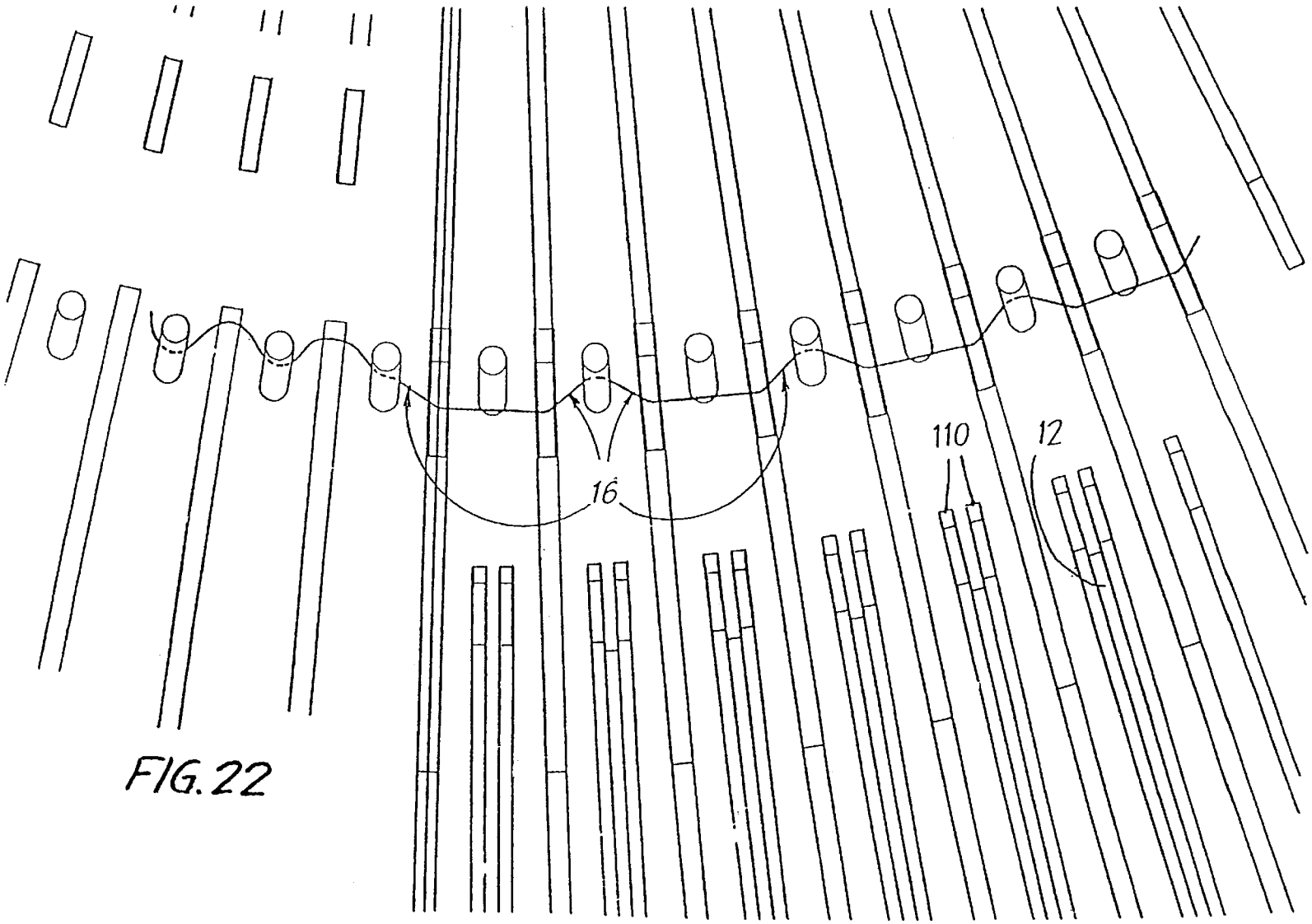
FIG. 22 shows a variant differing from the form shown in FIG. 19.
Figure 23:
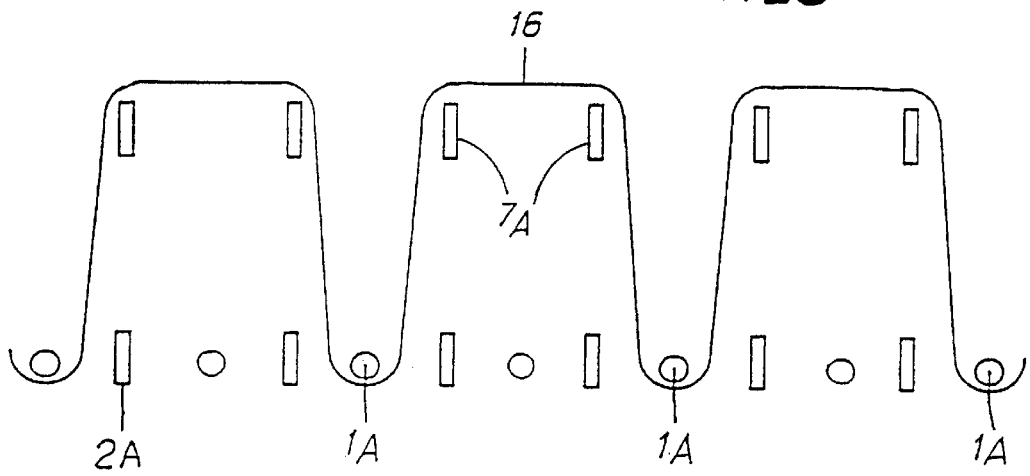
FIGS. 23 to 31 show an alternative embodiment differing from the form shown in FIGS. 1 to 21 in various conditions, for the initial loading of the needles.
Figure 24:
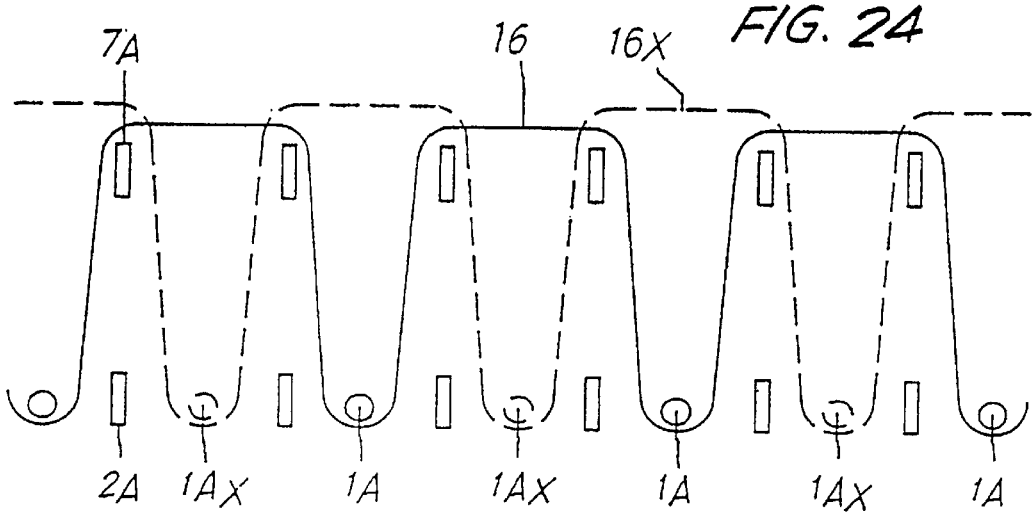
Figure 25:
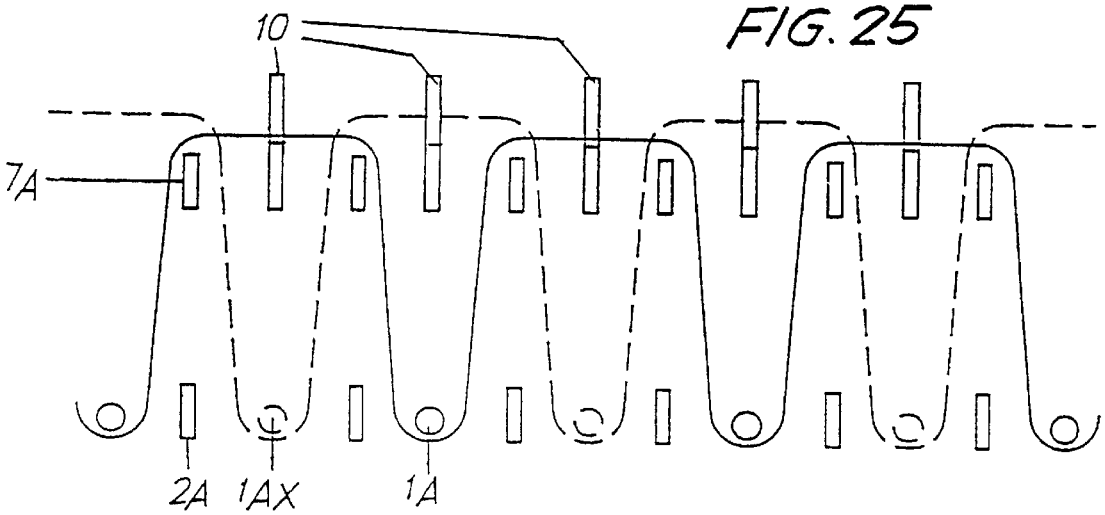
Figure 26:
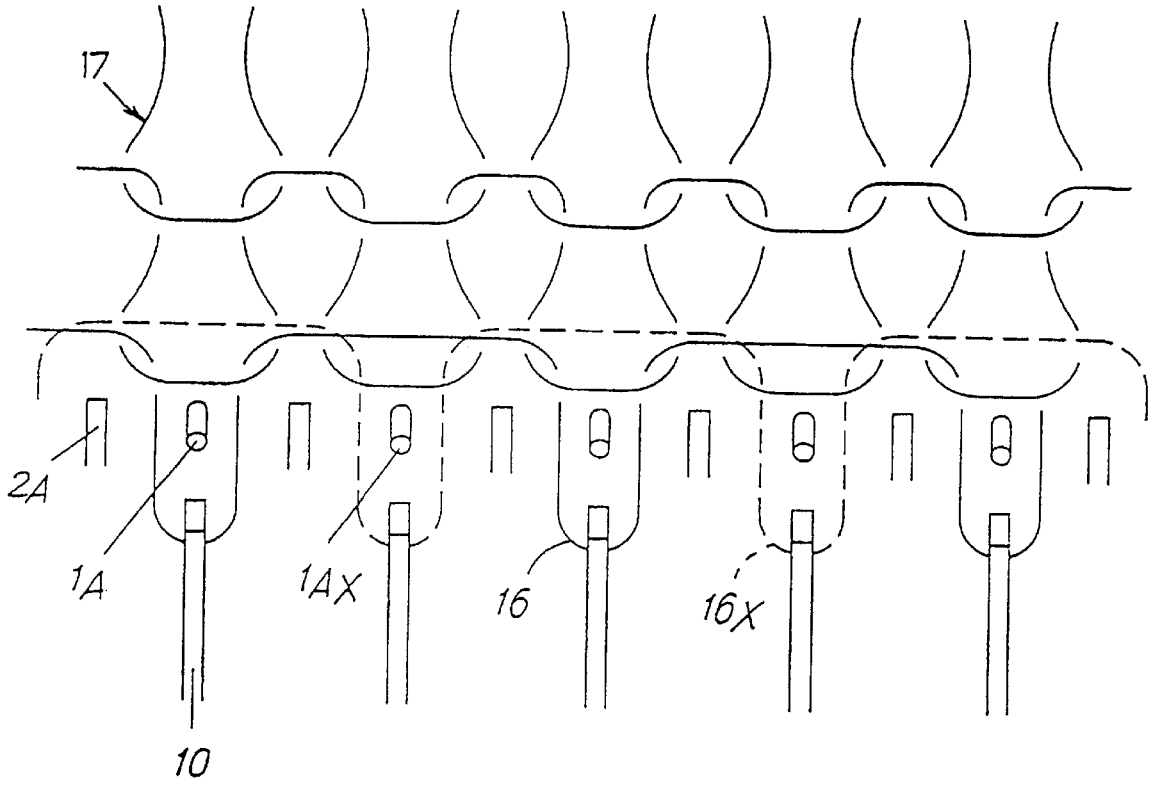
Figure 27:
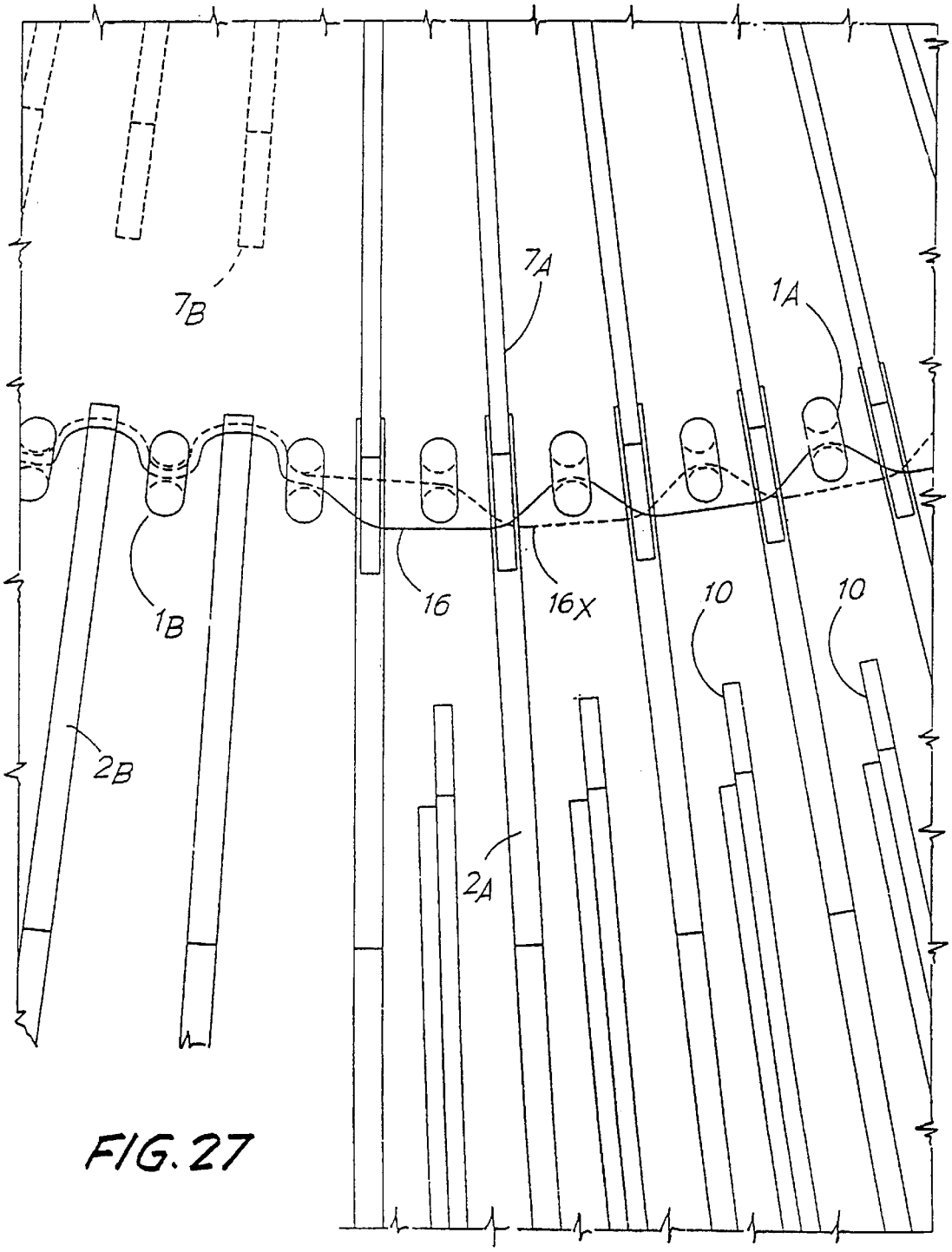
Figure 28:
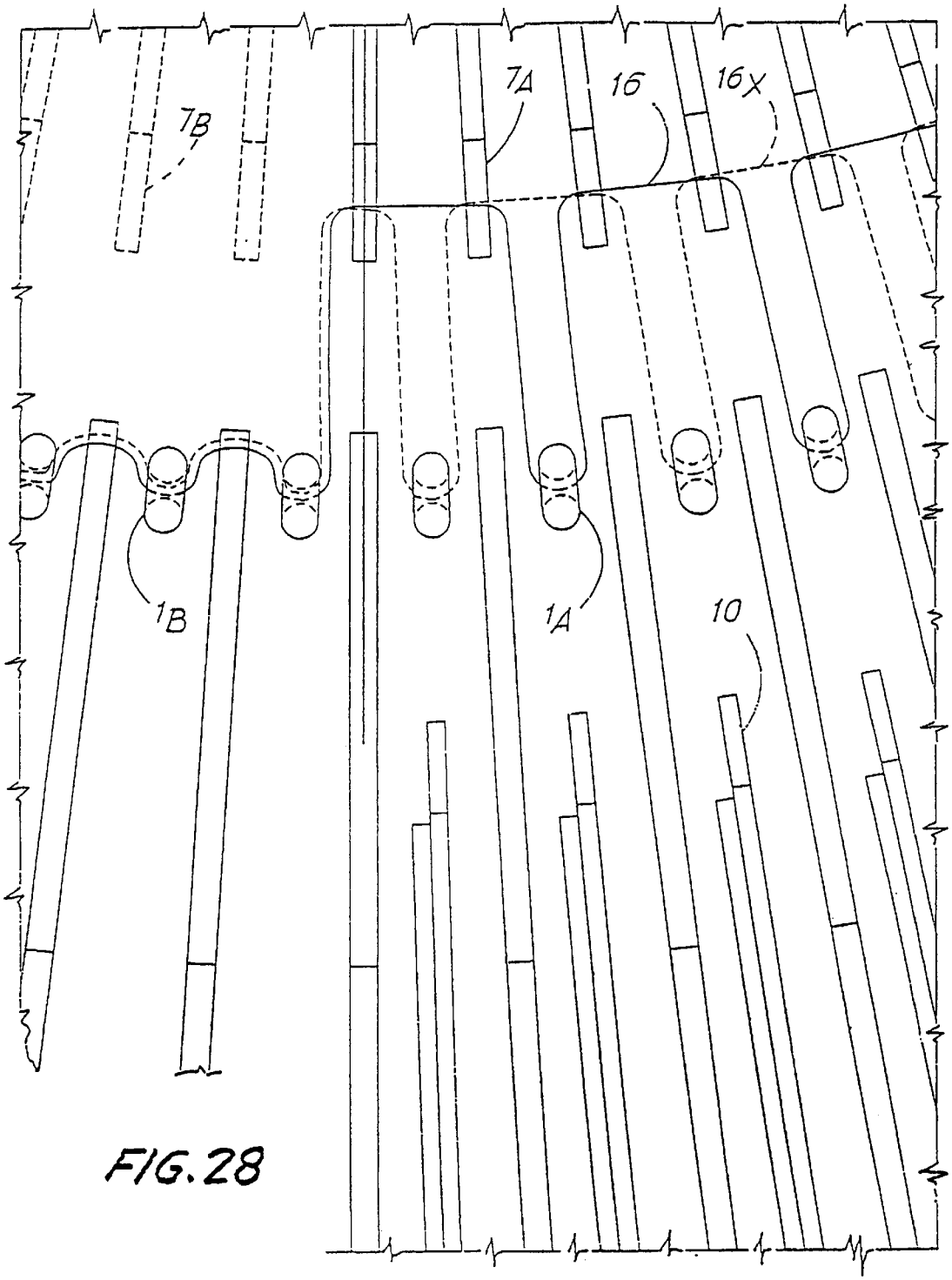
Figure 29:
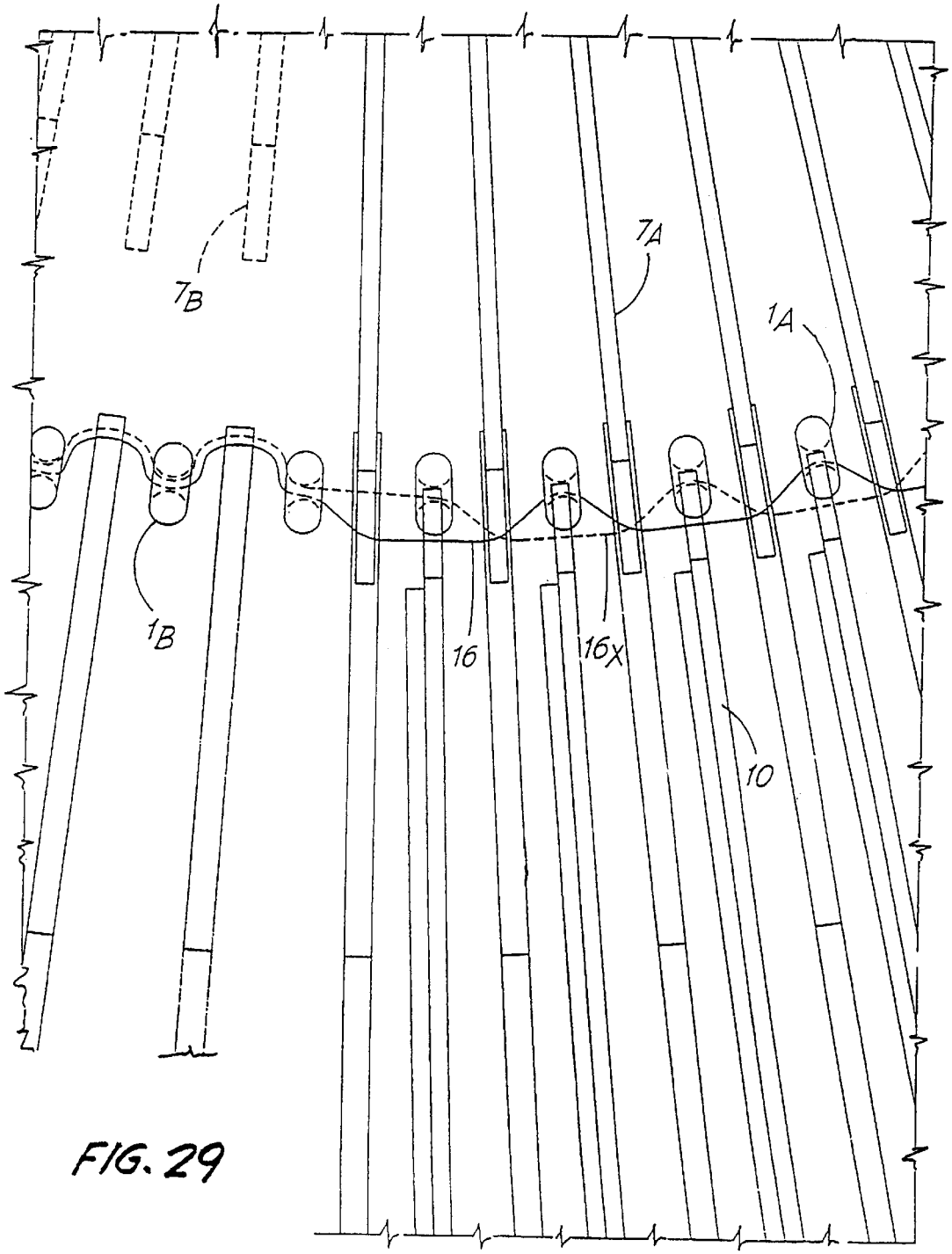
Figure 30:
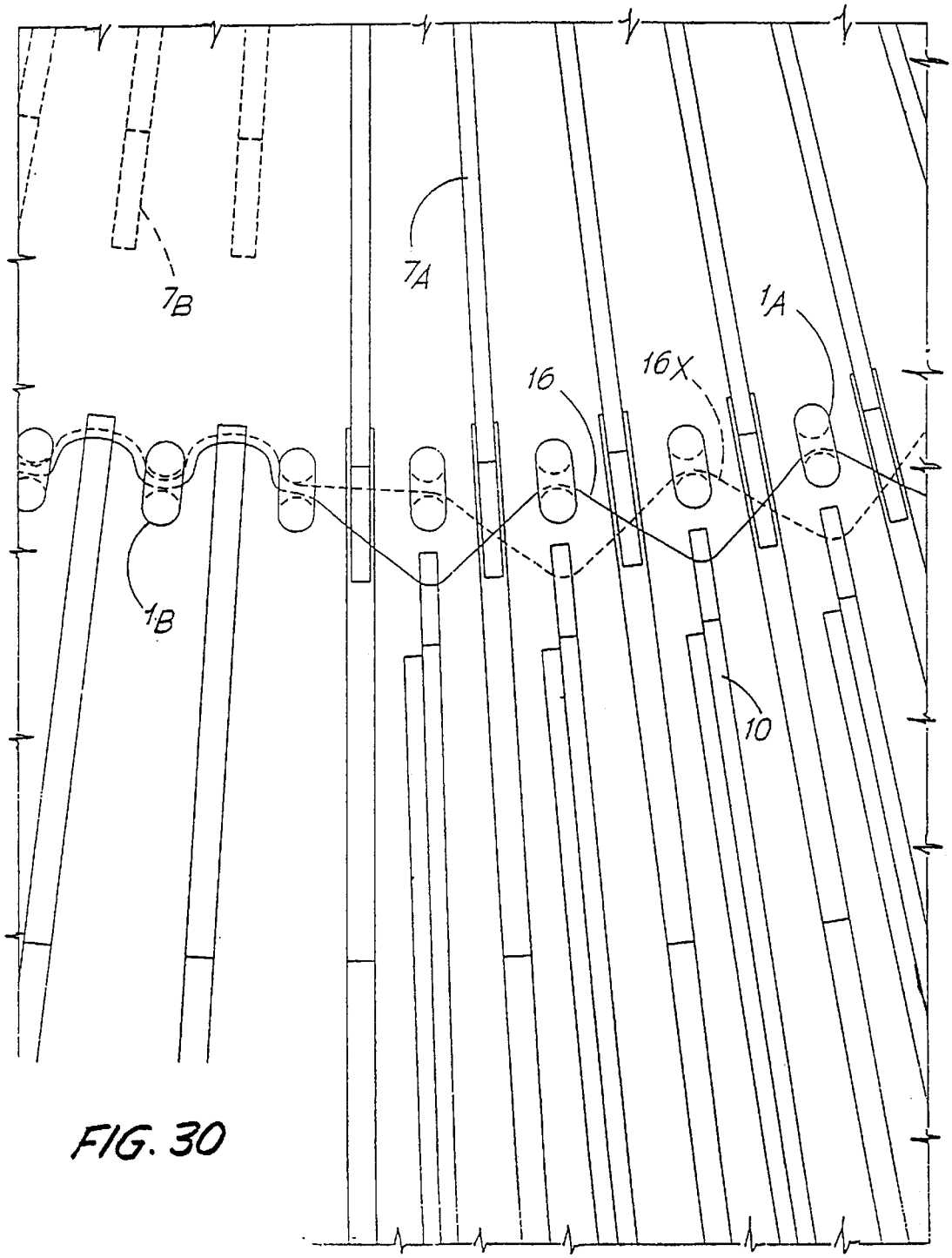
Figure 31:
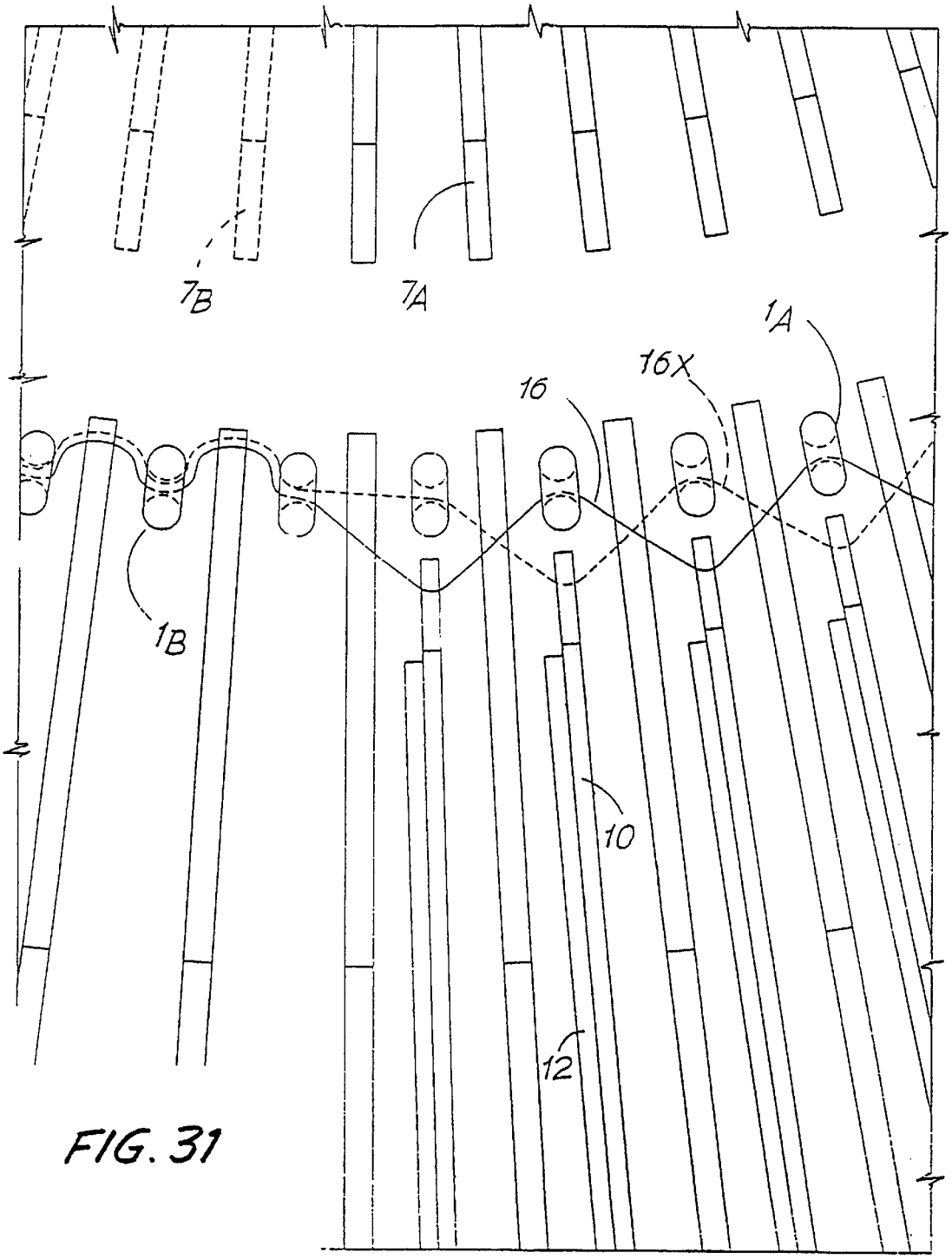

As illustrated in the accompanying drawing, the numeral 1 indicates the needles and the numeral 2 the sinkers of the needle cylinder, which is sketched at 3. The numeral 5 denotes the hook disc, which carries a series of radially distributed hooks 7 capable of radial movements. The hooks are subdivided into a semicircular sector A where the hooks are marked 7A and a complementary semicircular sector B where the hooks are marked 7B, and by analogy the needles of sector A are marked 1A and those of sector B are marked 1B. In the same way 2A and 2B are the sinkers of the respective sectors A and B. The two sectors A and B (see in particular FIG. 1) are defined and separated by a diametrical axis X—X, which is the axis of rotation of a half ring 9 (see in particular FIG. 1 and FIGS. 7 to 17); said half ring 9 can adopt two positions, one on the right and the other on the left when viewing FIG. 1, for rotation about the axis X—X, rising and falling as can be seen in particular in FIGS. 11 to 17. The half ring 9 has radial incisions or slots for the movement of pick-up hooks 10 shaped at the inward end into slightly curved crooked fingers 10A, which can be seen in isolation in FIG. 18; alongside each pick-up hook 10 is a corresponding closing slider 12, also shown in isolation in FIG. 18, which is specially shaped 12A at the inward end for the purposes indicated below. Each groove in the half ring 9 may carry a single pick-up hook 10, 10A and, alongside it, a closing slider 12, 12A, as is shown in FIGS. 19*ff*. Alternatively, each slit of the half ring 9 may contain a pair of pick-up hooks 110, 110A with a single closing slider 112, 112A between them, as shown in FIG. 22. Each hook 10, 10A, and the corresponding closing slider 12, 12A, is shaped so that when the closing slider 12, 12A is moved centrifugally with respect to the pick-up hook 10 in the corresponding slit in the half ring 9, the crooked finger 10A is exposed and can receive a loop, whereas when the closing slider is pushed centripetally with respect to the pick-up hook 10, the internal shaping 12A at the end of the slider closes off the recess of the hook 10A, engaging the loop even when the half ring 9 is thrown over from its position on arc A—in which the crooked fingers 10A of the pick-up hooks 10 are face up and the shaping of the closing sliders 12A is face down—to the opposite position of the half ring 9 on the arc B on which the position of the pick-up hooks 10 and closing sliders 12 is inverted. The pick-up hooks 10 and the closing sliders 12 are controlled by their respective butts (visible in FIG. 18 in particular), which are located on either side of their respective elements and are acted on by cams arranged around the needle cylinder in the working area of the needles. These cams act from below on the butts which in each position project down from the arc A and from the arc B into the working area of the cams, while the cylinder 3 and the half ring 9 which is mounted on the mechanism of the cylinder are actuated, during the operations involving the forming of the toe fabric in partial courses around the semicircle A as indicated below, either with reciprocating motion or with continuous motion and with cutting of the yarn at the end of each partial course.

In the version shown in FIGS. 1 to 21, the half ring 9 has its pick-up hooks 10 and the closing sliders 12 of the latter arranged behind alternate needles only, that is behind every other needle, as shown clearly in FIGS. 5 and 6 (by contrast in the version shown in FIGS. 23 to 31 a version is envisaged in which the pick-up hooks and their closing sliders are positioned behind each needle, as described later).

Figure 2:
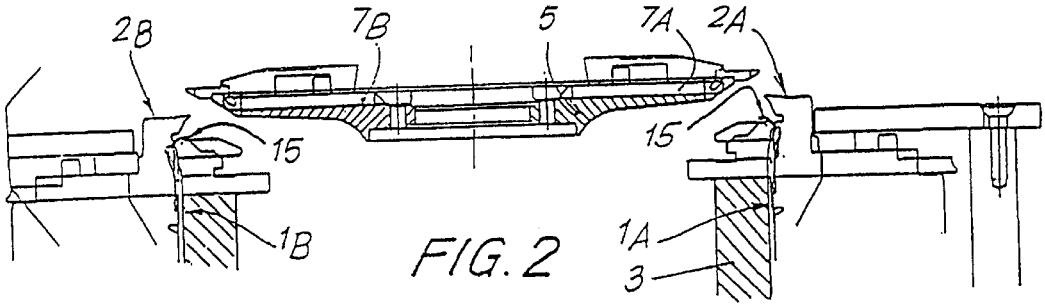
FIGS. 2, 2A; 3, 3A; 4 show three initial phases in the operation of closing the toe at the start of article production.
Figure 2A:
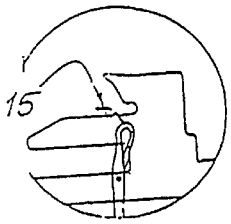
Figure 3:
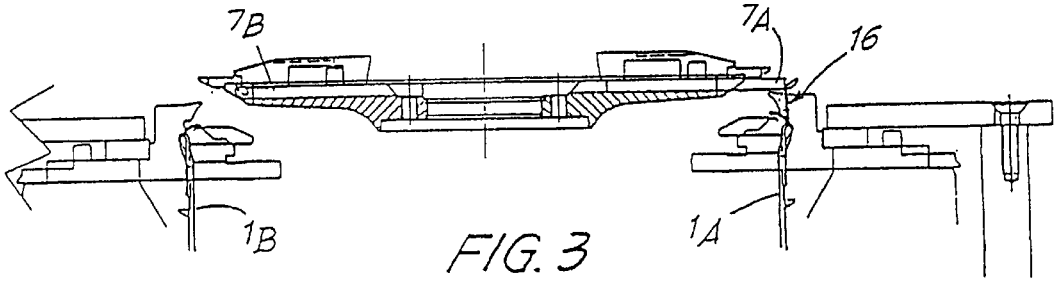
Figure 3A:
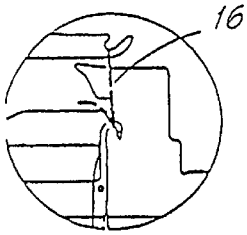
Figure 4:
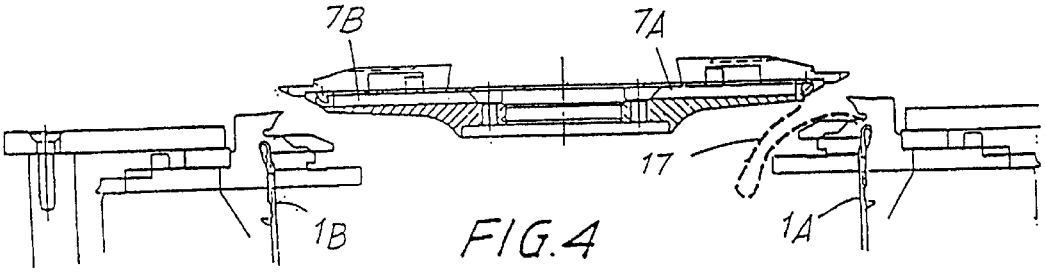

At the start of a production sequence the weaving operation is performed to close one end of the tubular article which is to be constructed after the toe fabric has been formed. At the start of the sequence (see FIG. 2) the needles 1 and the sinkers 2 of the cylinder 3 are actuated to form a lip 15 of fabric for loading the needles, structured so that it cannot be unroved. This lip of fabric 15 may be extremely narrow—as little as one or two courses, or at any rate a very small number of courses. Once this initial operation has been performed as shown in FIGS. 2 and 2A (which may be done with all the needles) the hooks 7A of the semicircle A of the disc 5 can be pushed out as shown in FIGS. 3, 3A and 5, and yarn is fed to form loops 16 between the needles 1A and the hooks 7A as shown in FIGS. 3 and 3A, while the hooks 7B of the needles 1B of arc B remain inactive. After this, a fabric 17 is constructed with partial courses (FIG. 4) to close the toe: this action is limited to the arc of needles 1A and to the arc of hooks 7A and involves motion of the cylinder 3 and disc 5 which may be reciprocating with increases and decreases in the number of needles in action as appropriate so as to produce a fabric 17 with drops and increases in the various partial courses, or else with circular motion of the needle cylinder and with cutting of the end of the yarn that has formed each of the partial courses and of a variable length; the fabric 17 is produced by techniques, known per se, for the lateral forming of the pouches of tubular knitted fabrics, as used for forming the toe fabric and/or heel fabric of articles.

Figure 5:
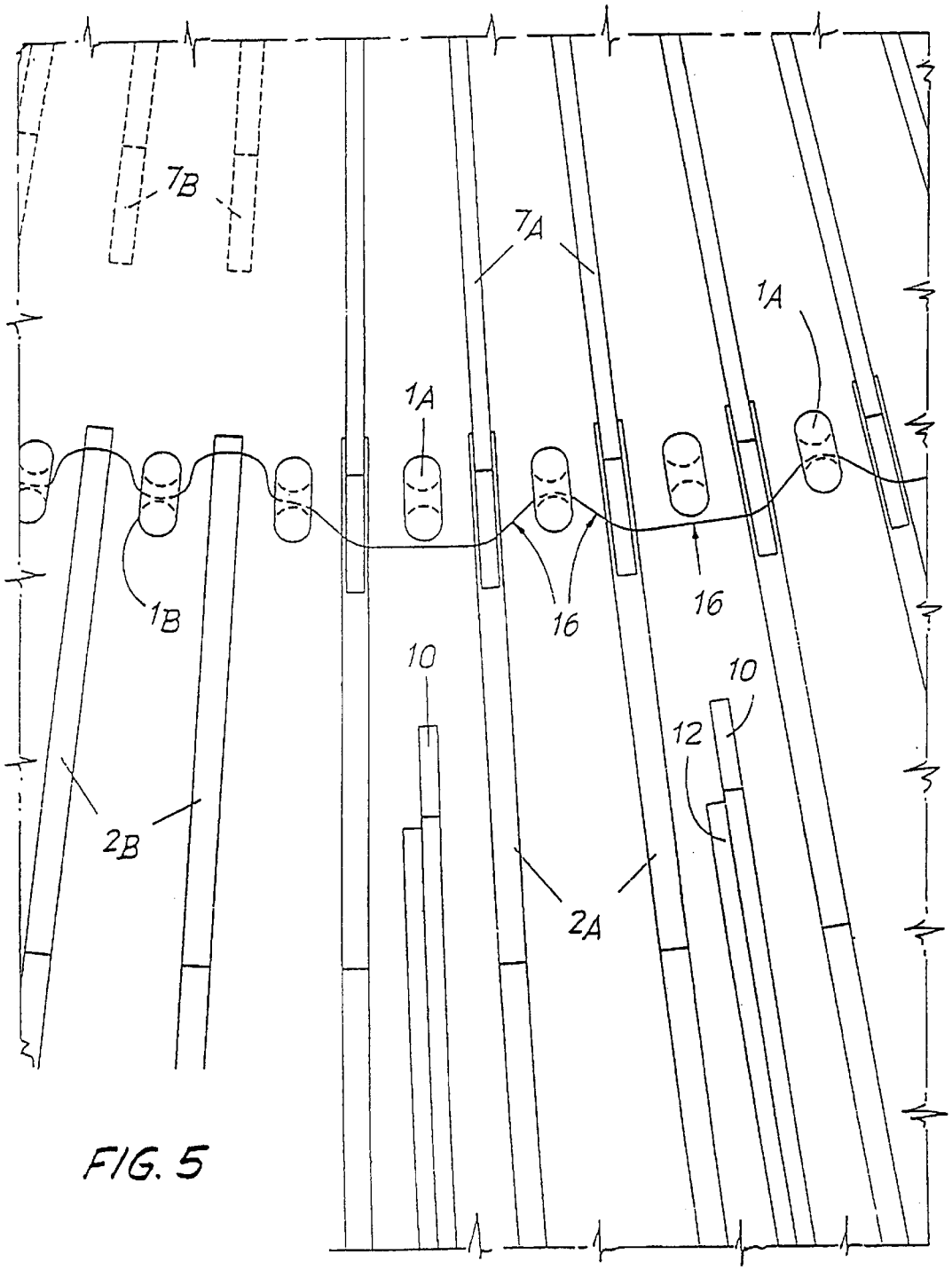
FIGS. 5 and 6 show two phases in enlarged partial plan view.
Figure 6:
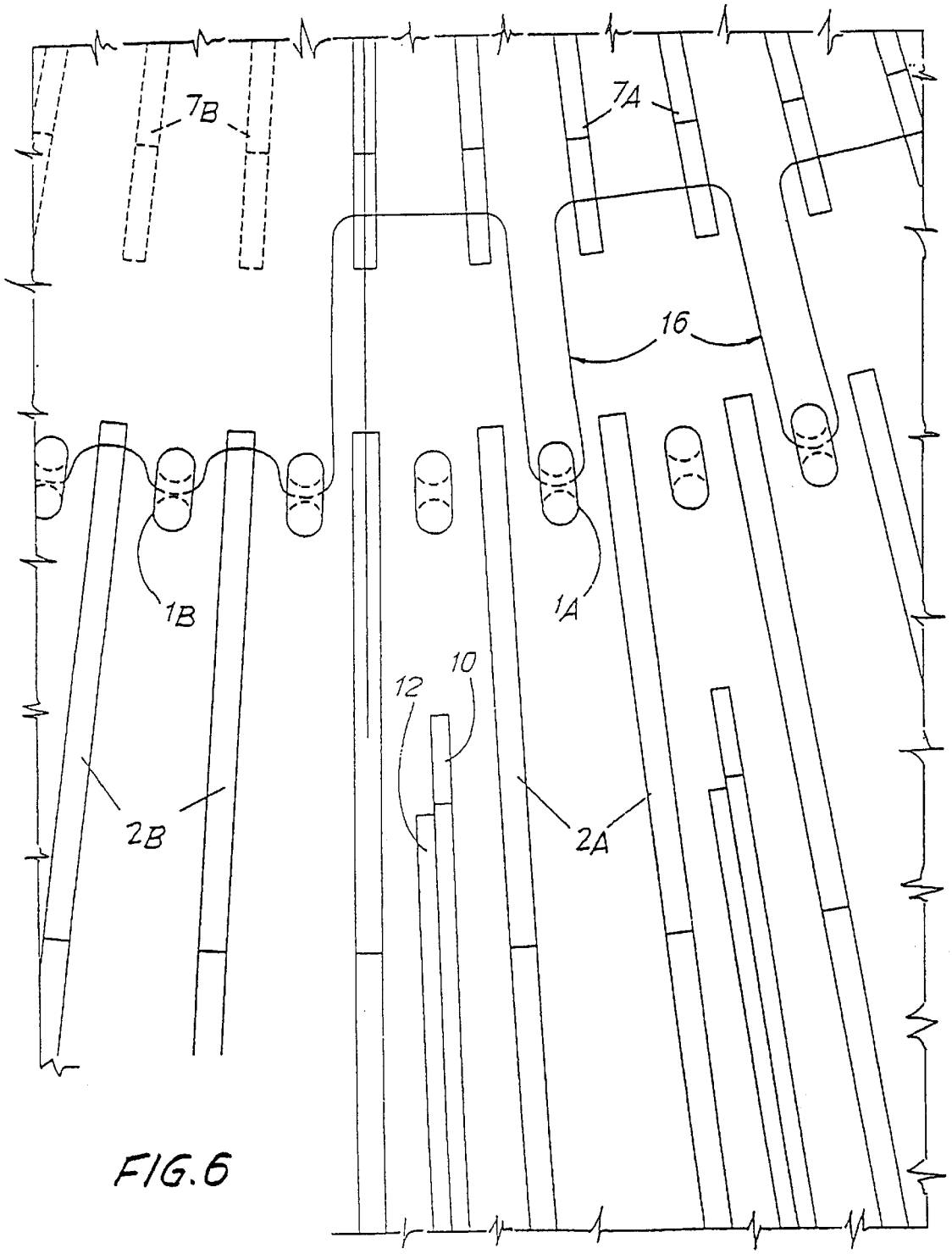
Figure 7:
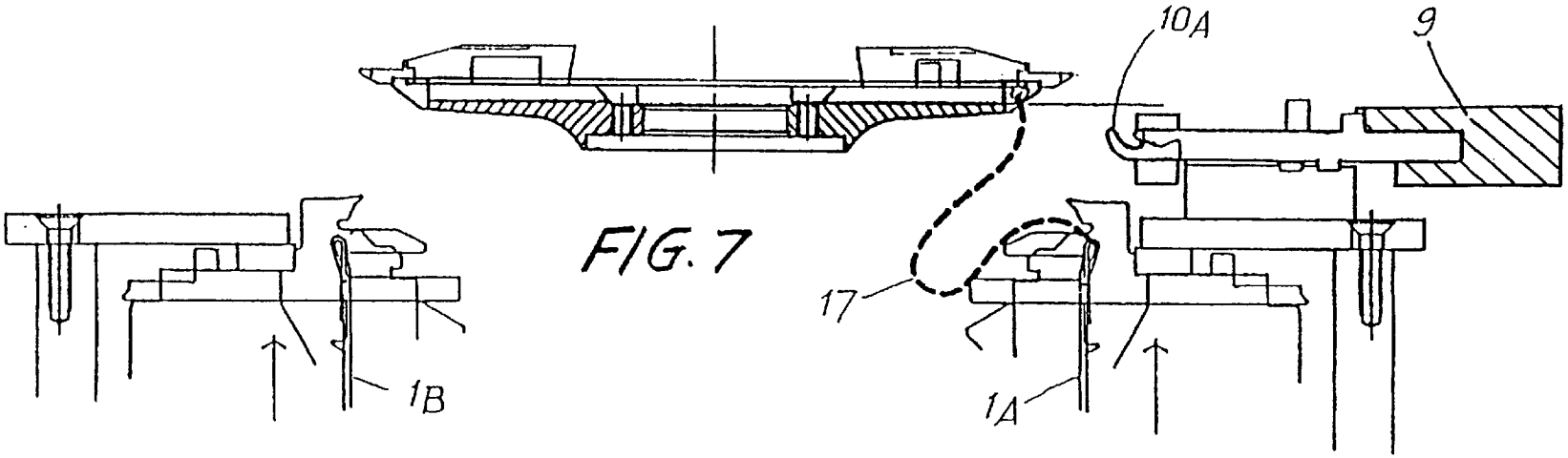

FIGS. 5 and 6 are partial plan views of, respectively, the condition of initial construction of the fabric as in the phase illustrated in FIG. 2, and the start of the phase of forming the fabric 17 with yarn feeding to form the loops 16 as shown in FIG. 3. It will be observed that the yarn is engaged by alternate needles while the loops 16 are laid over the two hooks 7A that lie between two active needles 1A in order to take the yarn forming these loops 16 (in the following version shown in FIGS. 23 to 31 the arrangement instead involves the successive formation of two courses of loops, with needles that have been used to form the first loops being replaced by the needles that have remained inactive during the formation of the first course of loops 16, as will be described in greater detail with reference to these figures).

Figure 8:
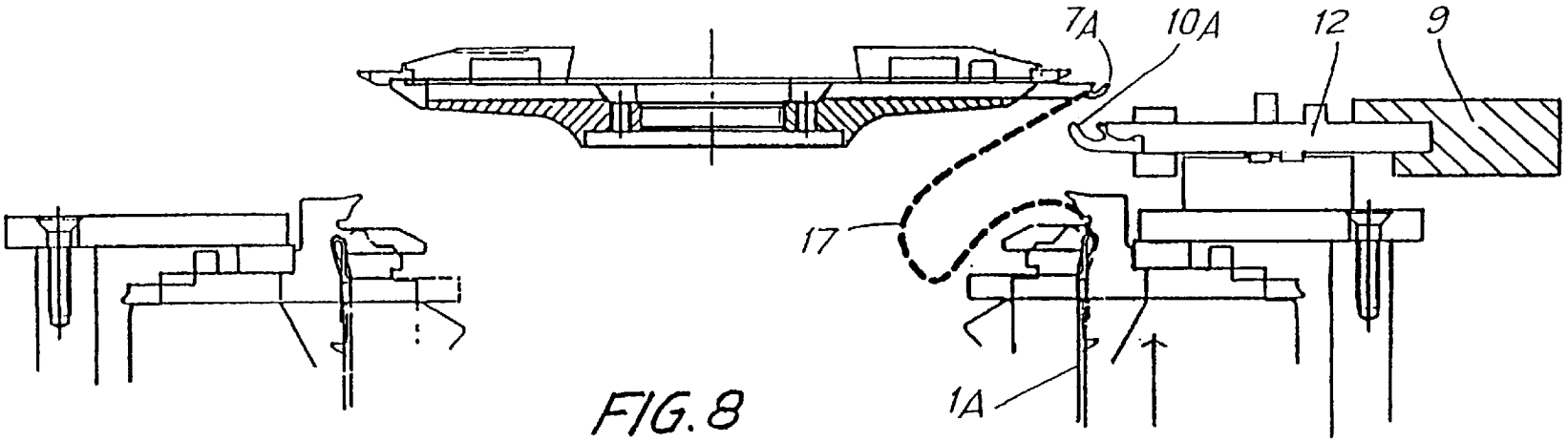
Figure 9:
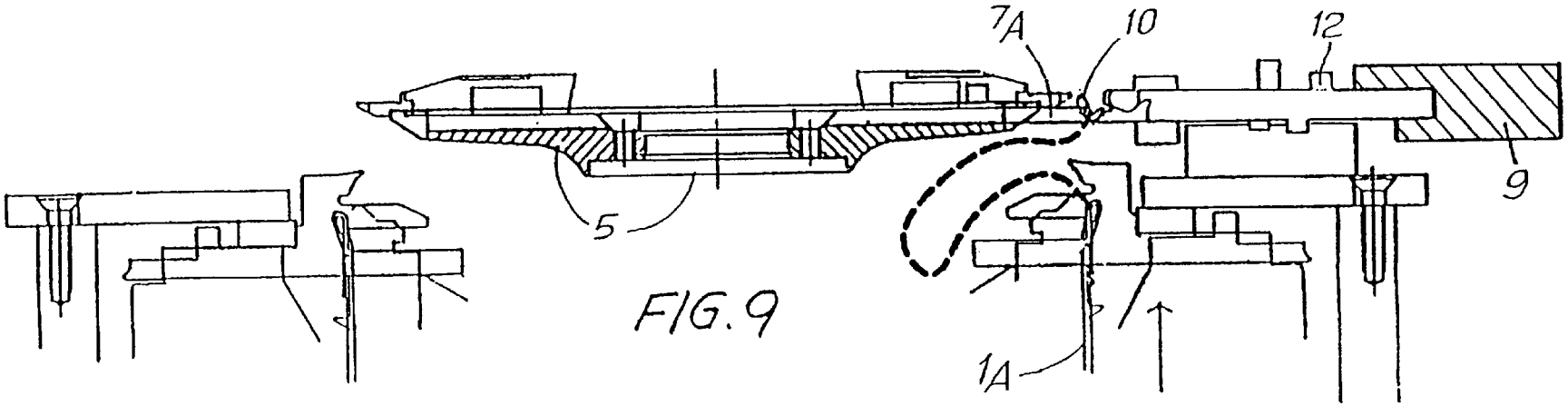

As can be seen by comparing FIGS. 3, 4 and 5, 6, the fabric 17 for the toe closure is made by retracting the hooks 7A centripetally during the formation of this fabric 17. After the fabric 17 has been formed (FIG. 7) in partial courses and in sufficient quantity to be able to be stretched over the cross-sectional area of the working area of the cylinder needles, the disc hooks 7A are advanced again as in FIG. 19 and the pick-up hooks 10 are advanced from the retracted position to a centripetally projecting position, as shown in FIGS. 8 and 20. FIGS. 8 and 20 also show that the hooks 7A are pushed forward over the crooked fingers 10A of the hooks 10, the disc 5 having been positioned axially on the axis of the needle cylinder at a level just above that at which the pick-up hooks 10 with their associated closing sliders 12 are lying; the closing sliders 12 remain withdrawn from the crooked fingers 10A on the ends of the pick-up hooks 10. The position of FIG. 9 succeeds to that of FIG. 8 by a lowering of the disc 5, so that the loops held by the hooks 7A can be deposited in the shaped ends 10A of the pick-up hooks 10, as can be seen in FIG. 9, the closing sliders 12 being still withdrawn from the crooked parts 10A. The next step, shown in FIG. 10, involves moving the closing sliders 12 up to the crooked parts 10A of the pick-up hooks 10, thereby forming an eye with the end 12A and the crooked parts 10A of the two cooperating components 10 and 12, while the hooks 7A are retracted centripetally to reach the position shown in FIG. 10 and 21, in which the loops 16 have been released by the hooks and engaged by the eyes formed by the shaped ends 10A and 12A of the pick-up hooks 10 and closing sliders 12; the final course of the partial fabric 17 for the toe remains engaged by the needles 1A by which it was formed. At this point the disc 5 is raised (see FIG. 11) and immediately afterwards the half ring 9 begins to rotate in the direction of the arrow f9 of FIGS. 11, 12, 13; the fabric 17 is transferred across the circumferential working area of the needle cylinder with the initial loops of this fabric 17 engaged by the eyes formed, as stated above, by components 10 and 12. The half ring 9 reaches the position shown in FIG. 14 on the opposite side from its initial position with respect to the axis X—X, that is to say the half ring 9 is in position over the arc B of needles 1B, which have remained inactive while the fabric 17 was being formed, with the lip 15 of fabric with which the needles were loaded waiting on these needles 1B. The position of FIG. 14 and of FIG. 15 having been reached, the needles 1B are raised and poked through the initial end of the fabric 17 (see FIG. 15) in the vicinity of the eyes formed by components 10, 12, which have held the initial loops 16 of this fabric; consequently, by lowering the needles 1B, the raising of which has engaged the yarn fed to them, the end of the fabric 17 is engaged by these needles 1B (see FIG. 16).

It is at this point that work on the tubular article T can be commenced, while the disc 5 can be moved back down to await the next cycle, after the half ring 9 has been swung back in the opposite direction to the arrow f9 to return to its initial position corresponding to the semicircle A, all of this taking place while the forming of the fabric T is proceeding, as can be seen in FIG. 17. The fabric 17 as visible in FIG. 17 has lines 17A of drops and increases created during the forming of the fabric by adding and deleting needles from the arc of active needles 1A.

Figure 15:
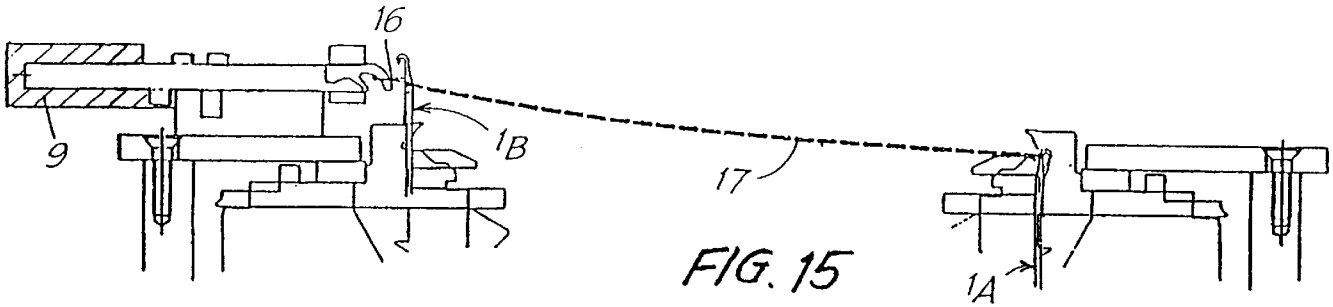
Figure 16:
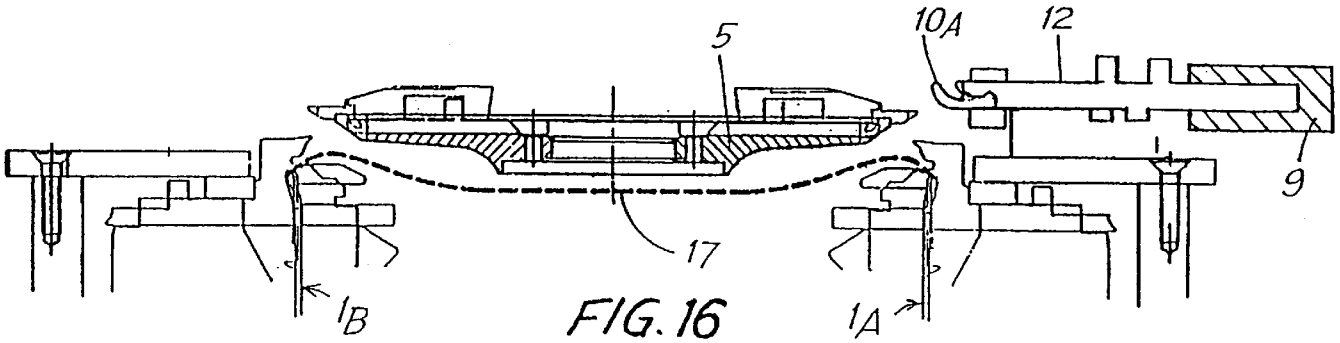

T1 denotes the join line between the toe fabric 17 and the tubular fabric T formed after the condition of FIG. 16 has been reached. Around the connecting line T1 between the toe fabric 17 and the tubular fabric T are lips of loading fabric 15 and especially the lip of fabric formed between the loops 16 and the needles 1B which pass through the fabric as shown in FIG. 15, these needles having to engage the fabric 17 not too close to the loops 16 themselves. However, these lips are very small.

Figure 10:
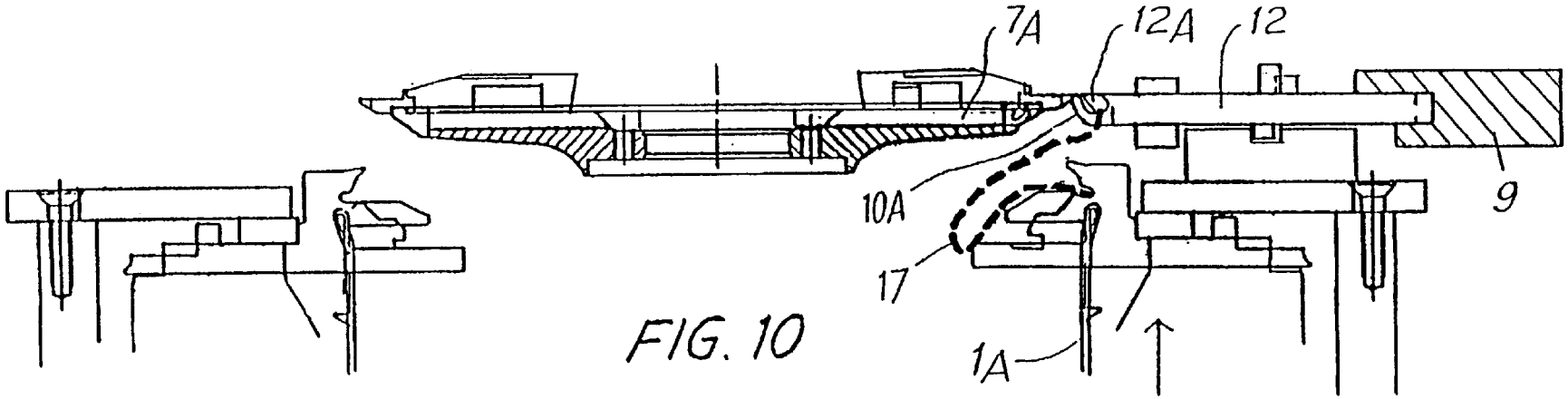
Figure 11:
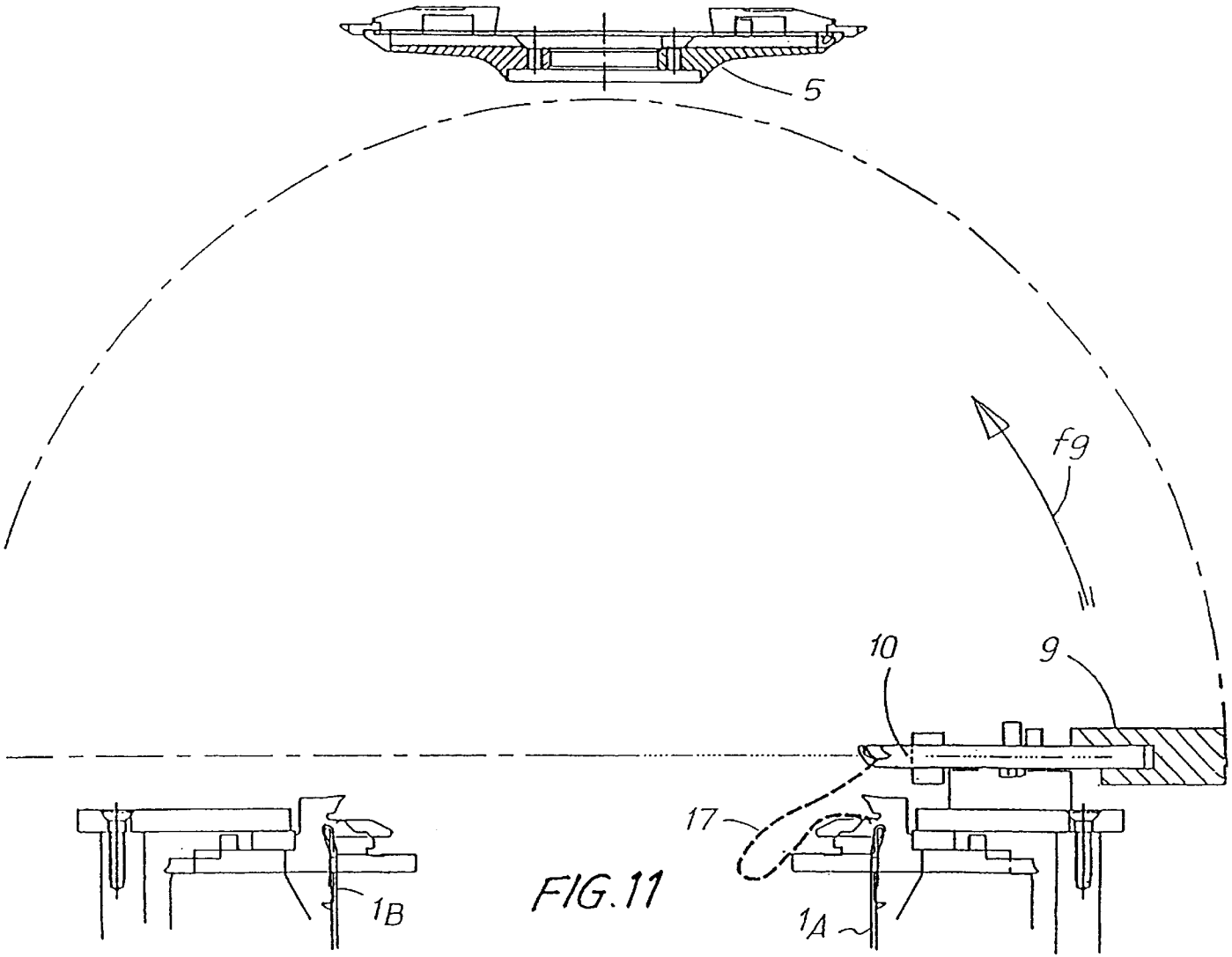
Figure 12:
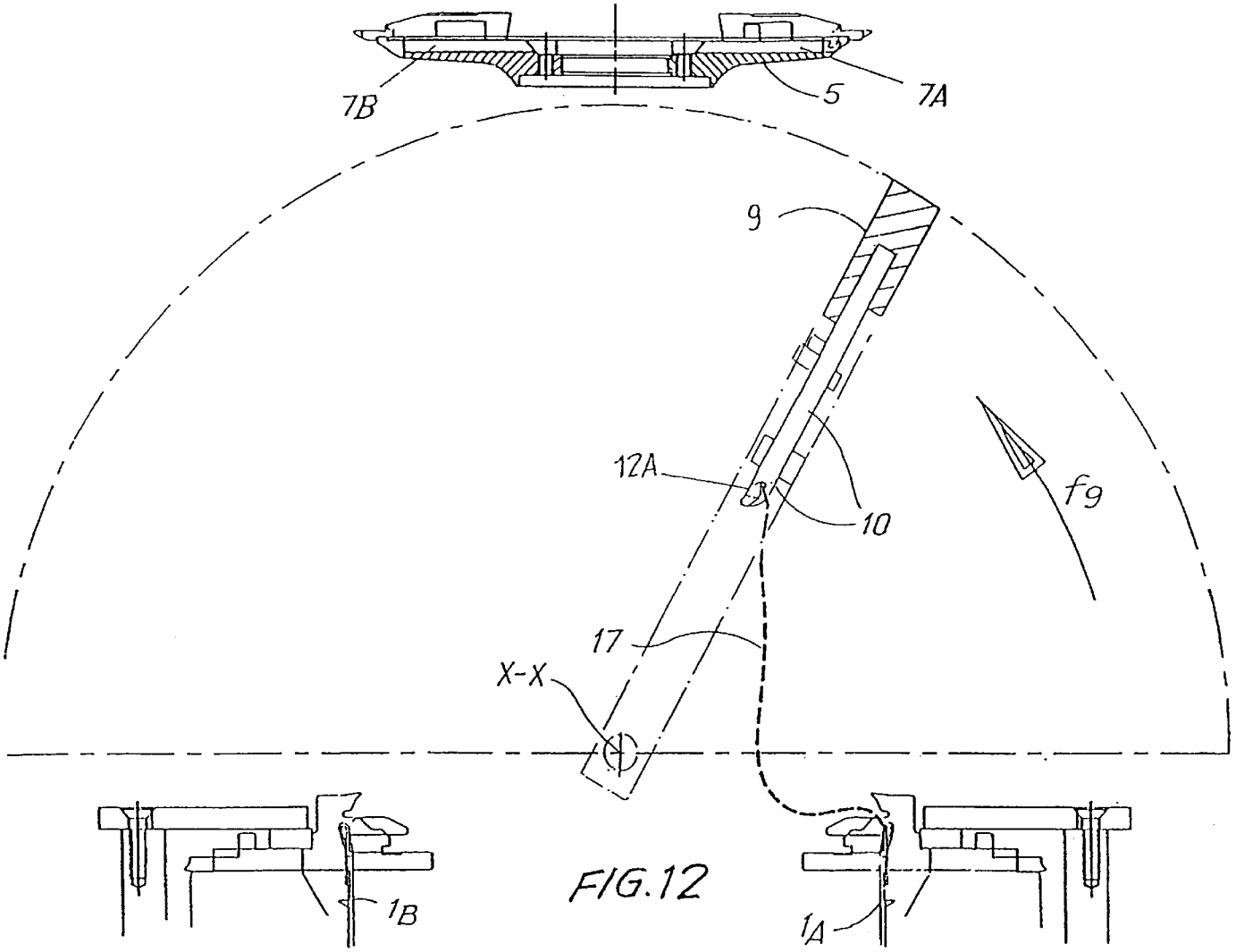
Figure 13:
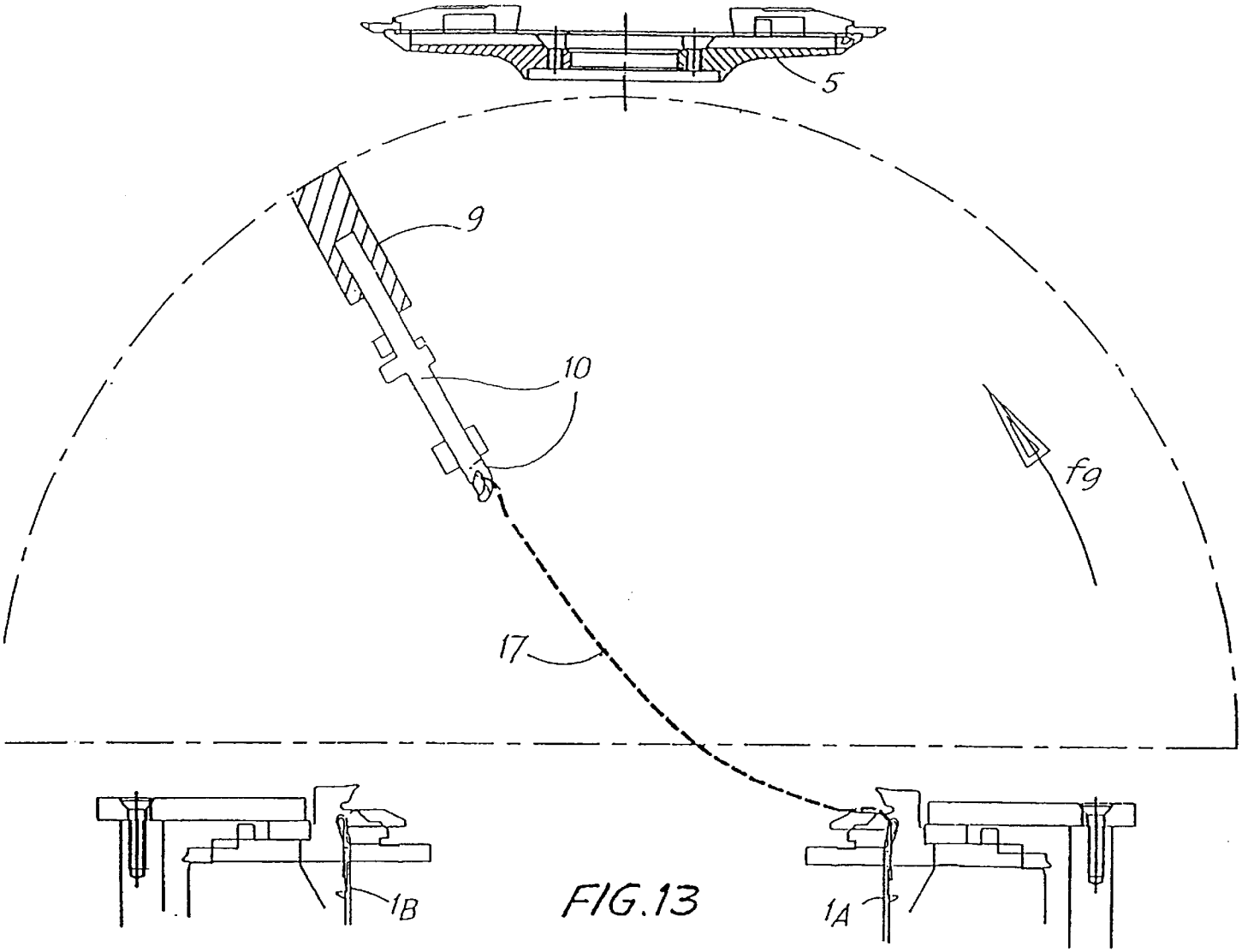
Figure 14:
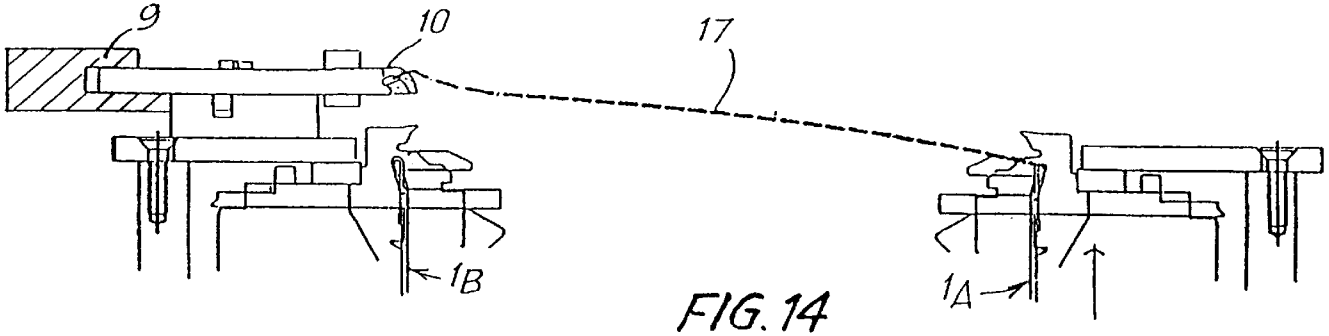
Figure 19:
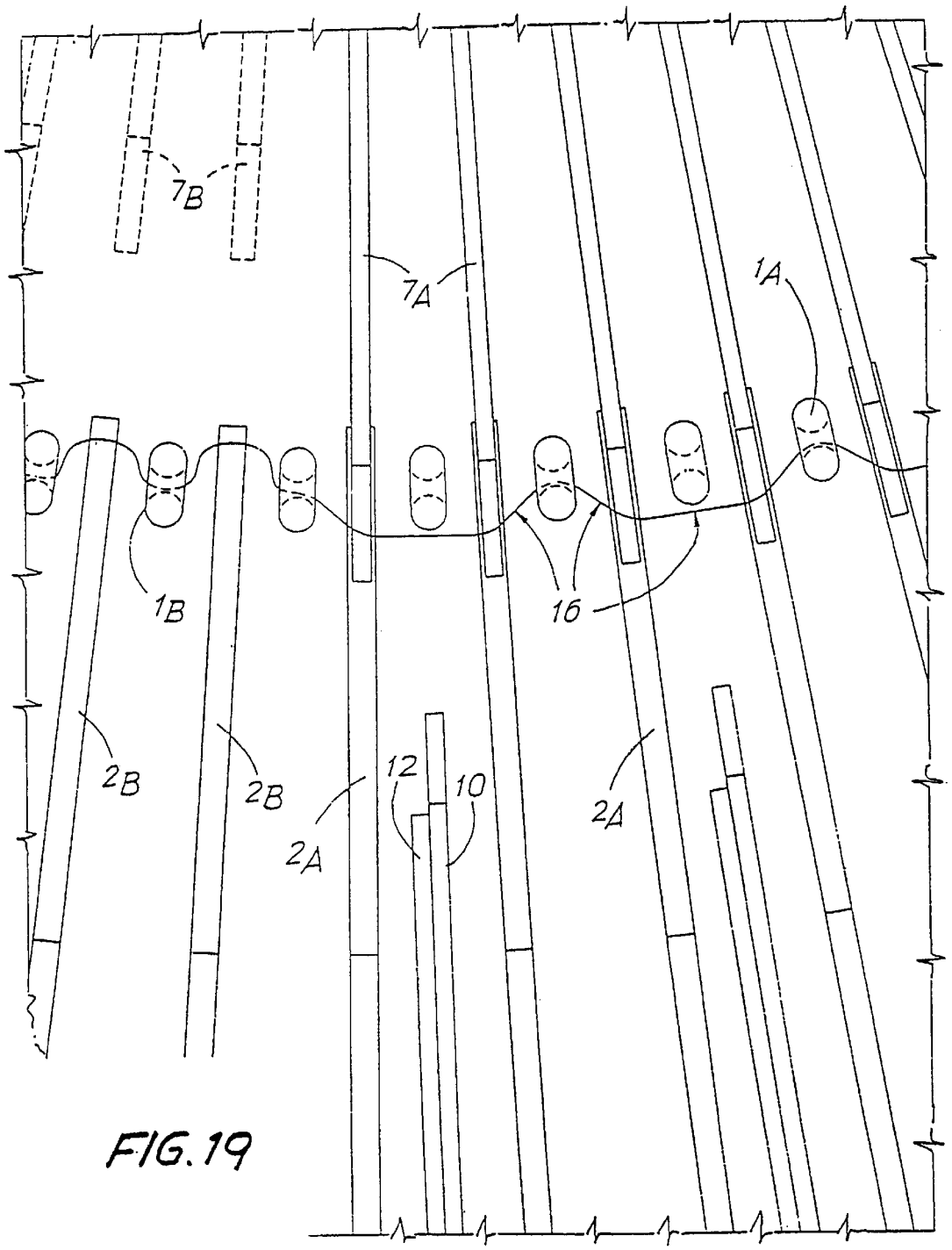
FIGS. 19 to 21 show partially in plan view certain phases of the transfer.
Figure 20:
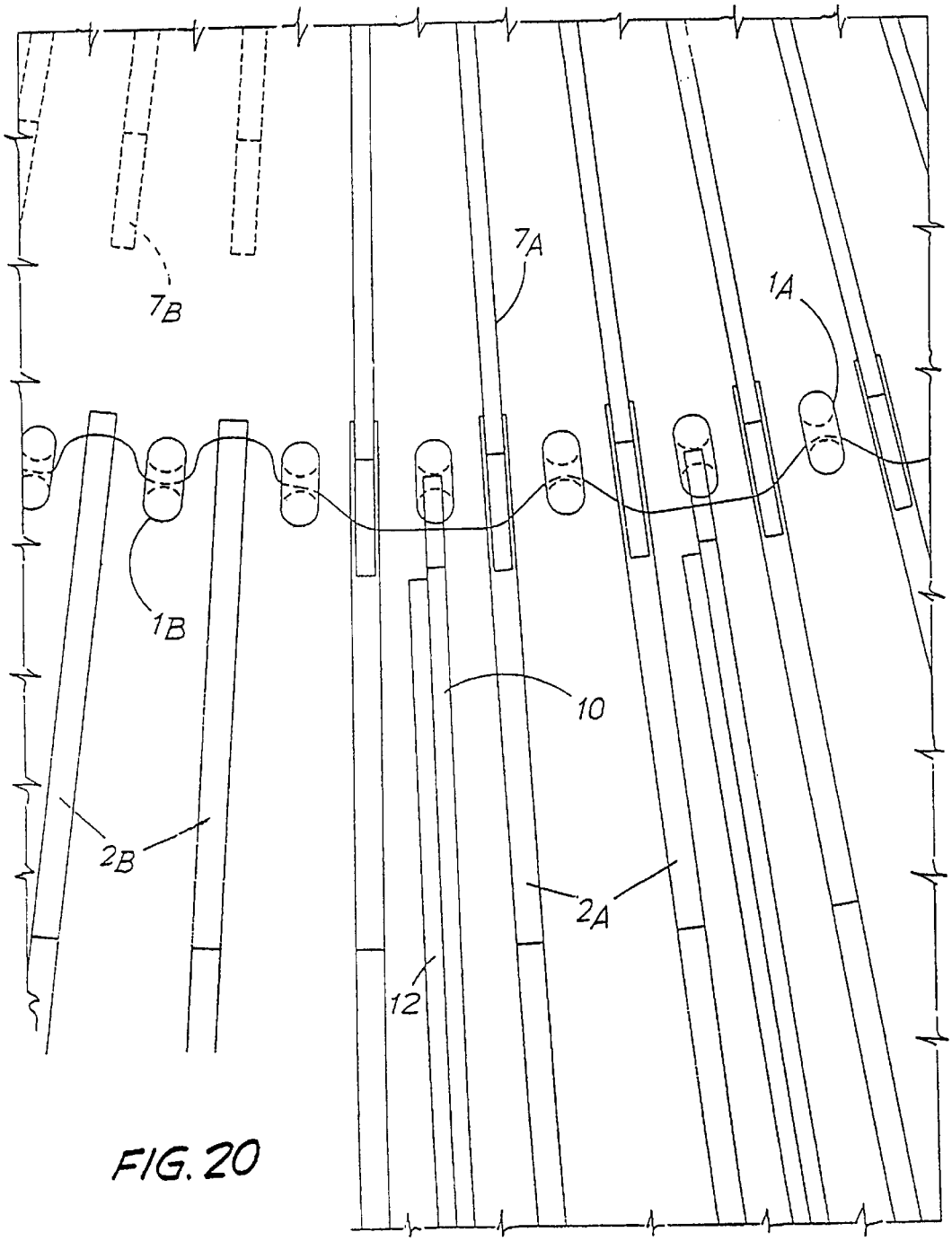
Figure 21:
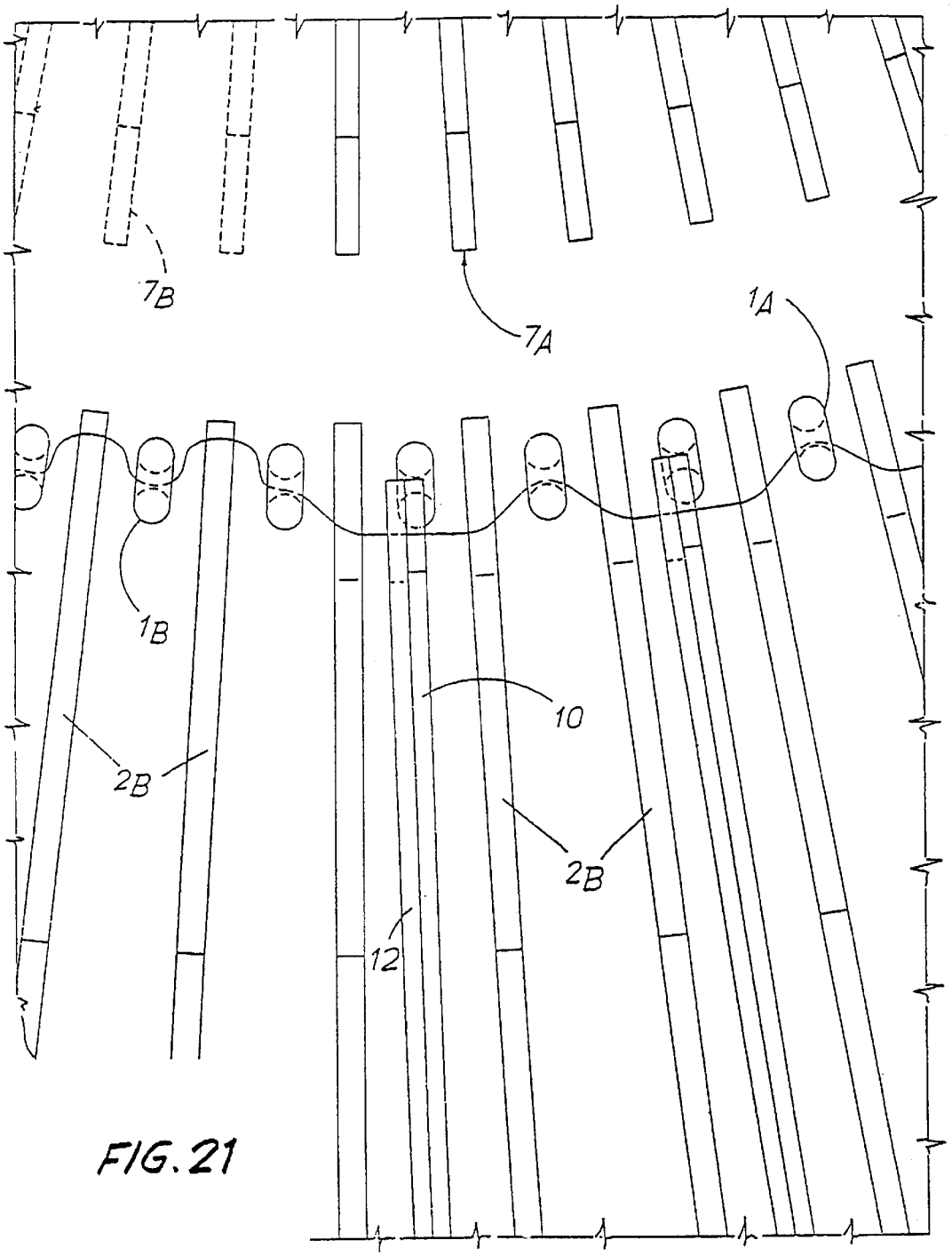

FIGS. 19, 20 and 21 depict certain phases in partial plan view corresponding to the phases of FIGS. 3, 9 and 10, respectively.

Said FIGS. 19 to 21 illustrate an arrangement in which there is only one pick-up hook 10 in each slit of the half ring 9 with a closing slider 12 next to it, as also in said FIGS. 27 to 30. In FIG. 22 there are two pick-up hooks 110 and one closing slider 112 between them.

FIGS. 23 to 31 show an arrangement in which all the needles 1A are loaded rather than alternate needles only as in the version of FIGS. 1 to 21 in which the loops 16 are formed between alternate needles 1A, which may look both unattractive and be weak. In accordance with FIGS. 23 to 30, work is commenced by forming the initial loops 16 engaged by the pairs of hooks 7A and by the alternate needles 1A that are visible in FIG. 23 (which does not show needles 1A that remain inactive in this first phase and as occurs in the previous version); in FIGS. 24 and 25 a second and successive series of loops 16X is shown being formed with a second feed of yarn, this time bringing into use the needles 1AX that had been inactive during the forming of the first series of loops 16. In this way two series of loops 16 and 16X are formed and loaded onto the hooks so that loops are created that are engaged on all the needles 1A, 1AX and not only on half the needles 1A as in the previous example. In this example the pick-up hooks 10 are not positioned behind alternate needles (as in the previous example and as shown in particular in FIGS. 5 and 6) but behind all the needles 1A and 1AX, so that the pick-up hooks 10 are present behind all of the loops 16 and 16X, as FIG. 25 in particular shows. In this embodiment, initial loops 16 and 16X are formed on all of the needles 1A of the semicircle of needles corresponding to the half ring 9 and these loops 16, 16X are carried by a corresponding number of pick-up hooks 10; in FIG. 26 the beginning of the fabric 17 from which the toe will be formed can be observed hooked with twice as many loops 16, 16X as in the previous example.

FIGS. 27 to 31 show, in partial plan view, phases in the cycle corresponding to the conditions of FIGS. 23 to 26, and hence in positions analogous to those of FIGS. 3, 8, 9 and 10.

FIGS. 32*ff* show an embodiment in which the toe is closed after the tubular article has been formed rather than before it is started. In these figures the members for creating the article are the same as in the previous embodiment and carry the same reference numerals.

Figure 32:
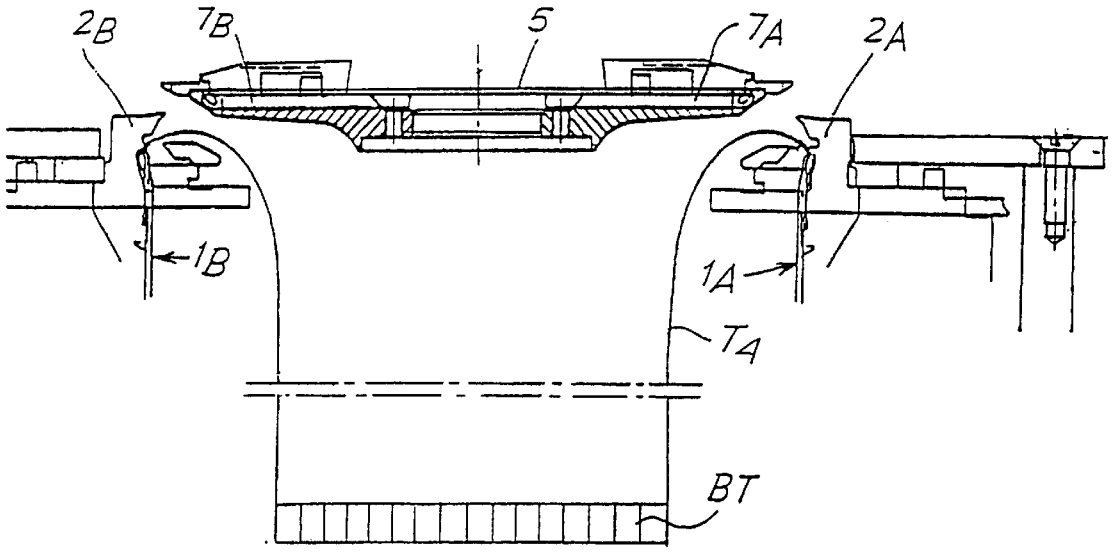
FIGS. 32 to 46 show another variant for making a closed toe at the end of the formation of a tubular article.
Figure 33:
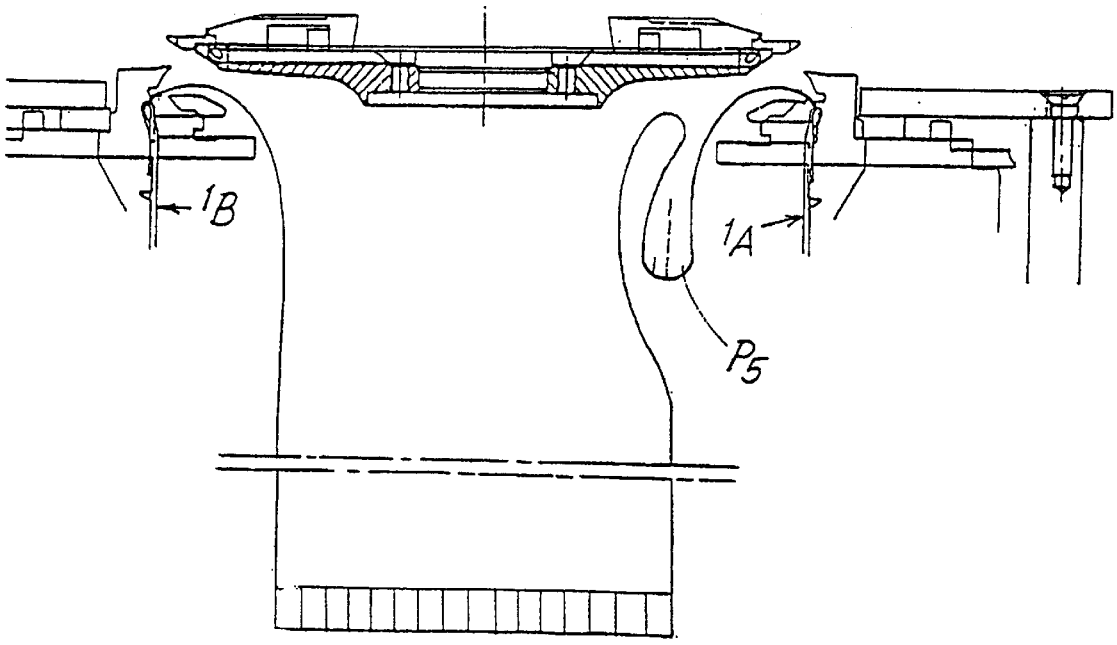
Figure 34:
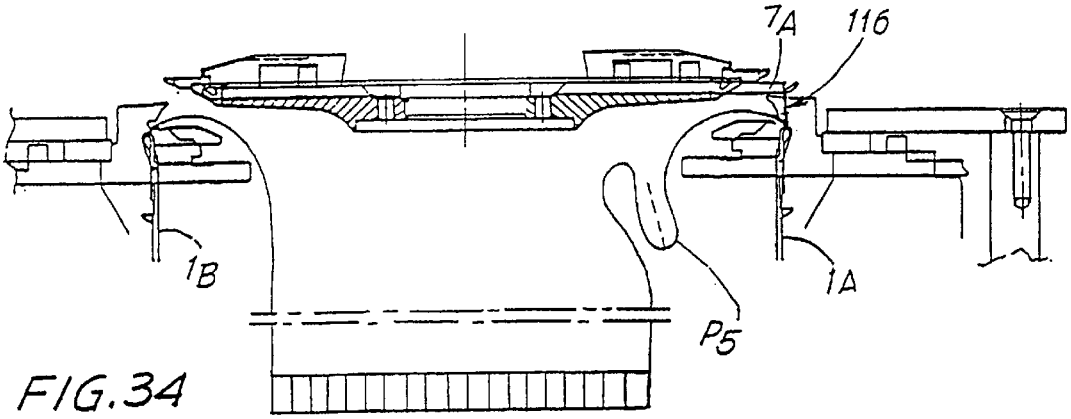
Figure 35:
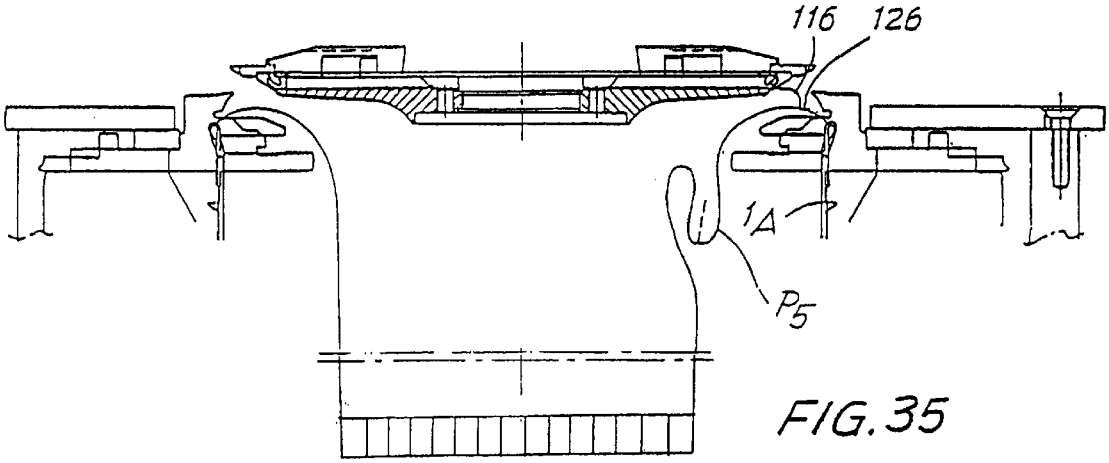
Figure 36:
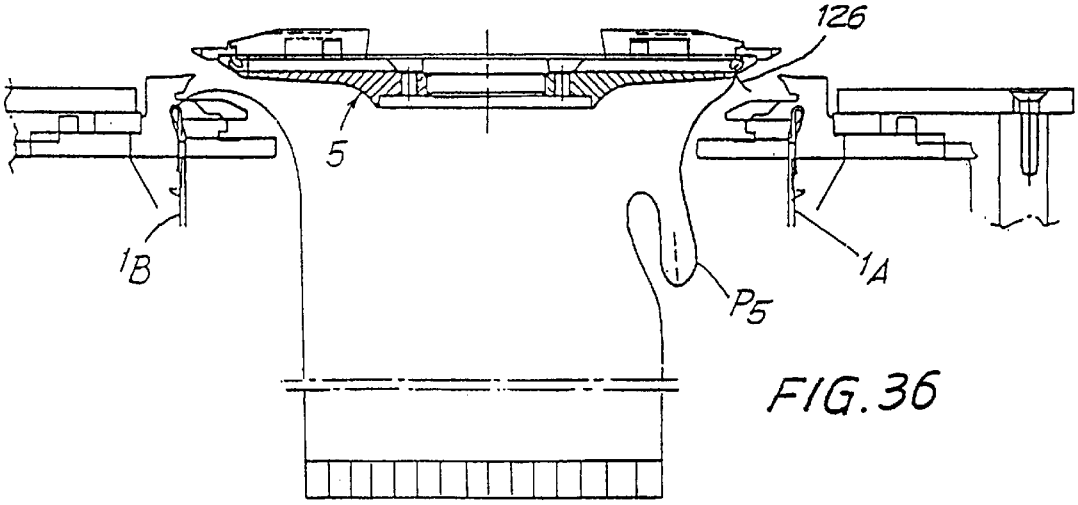
Figure 37:
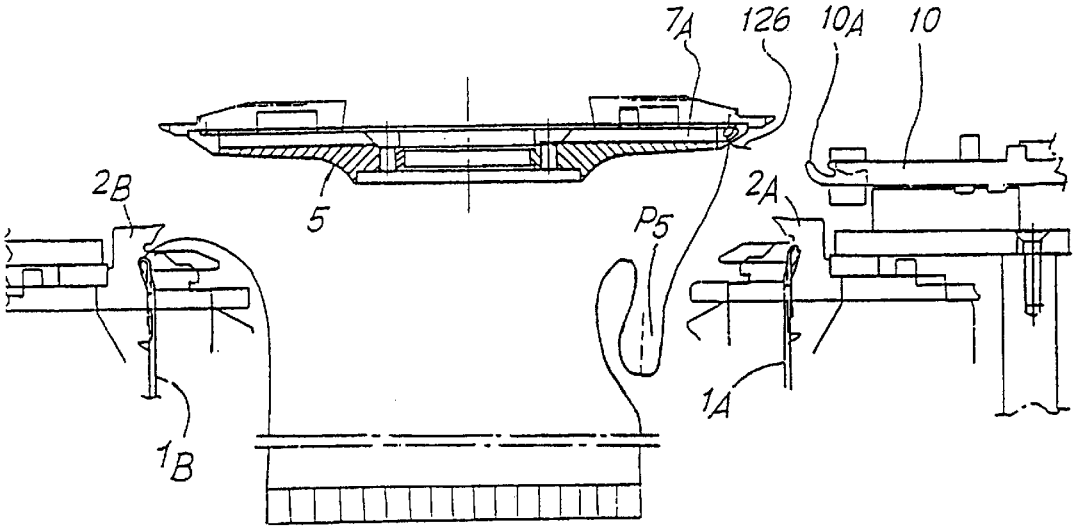
Figure 38:
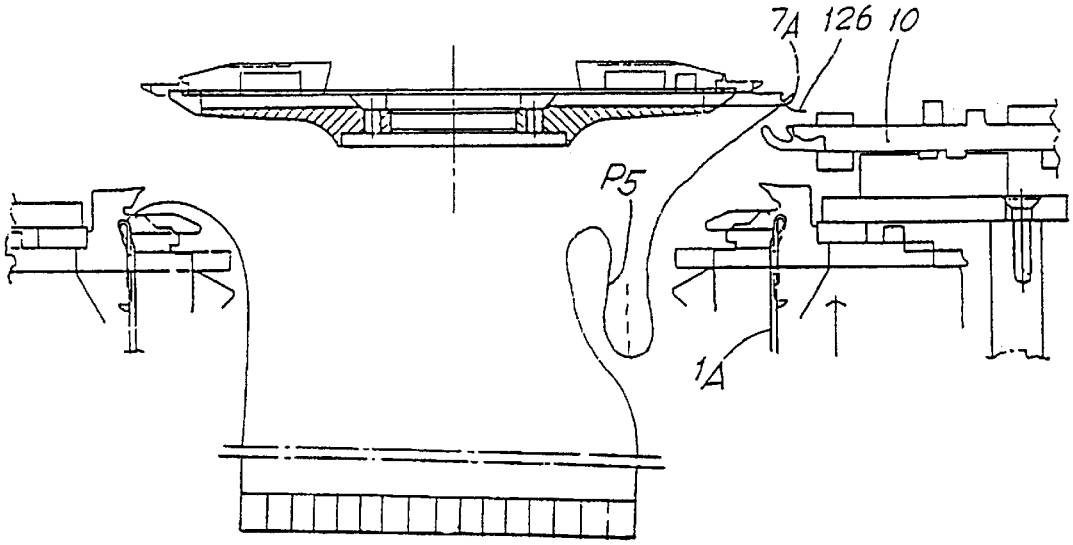
Figure 39:
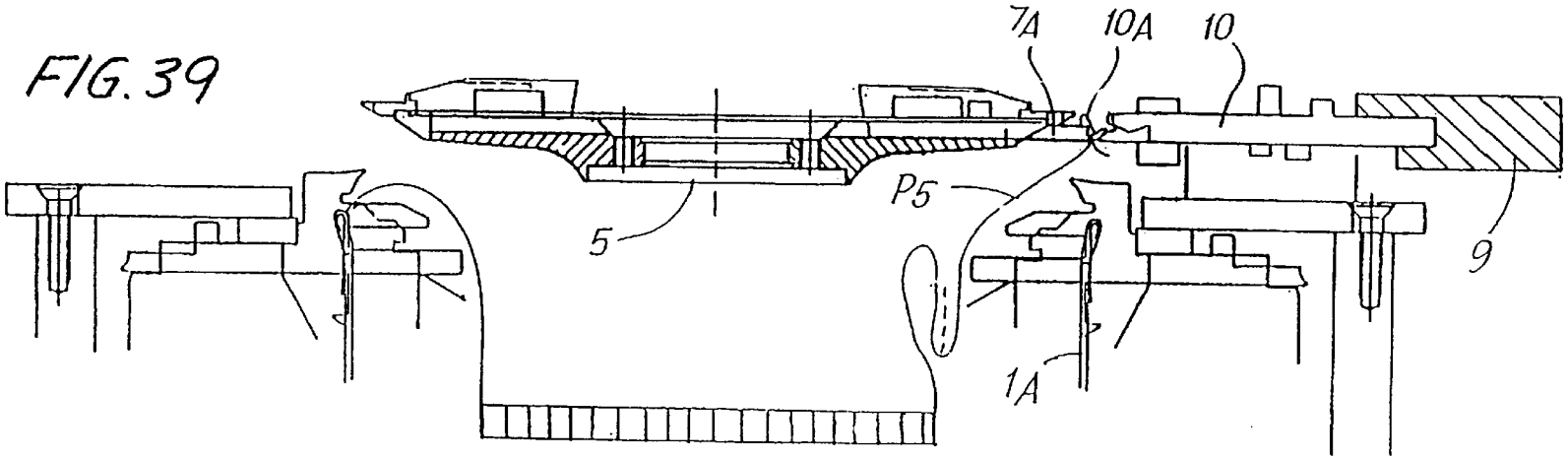
Figure 40:
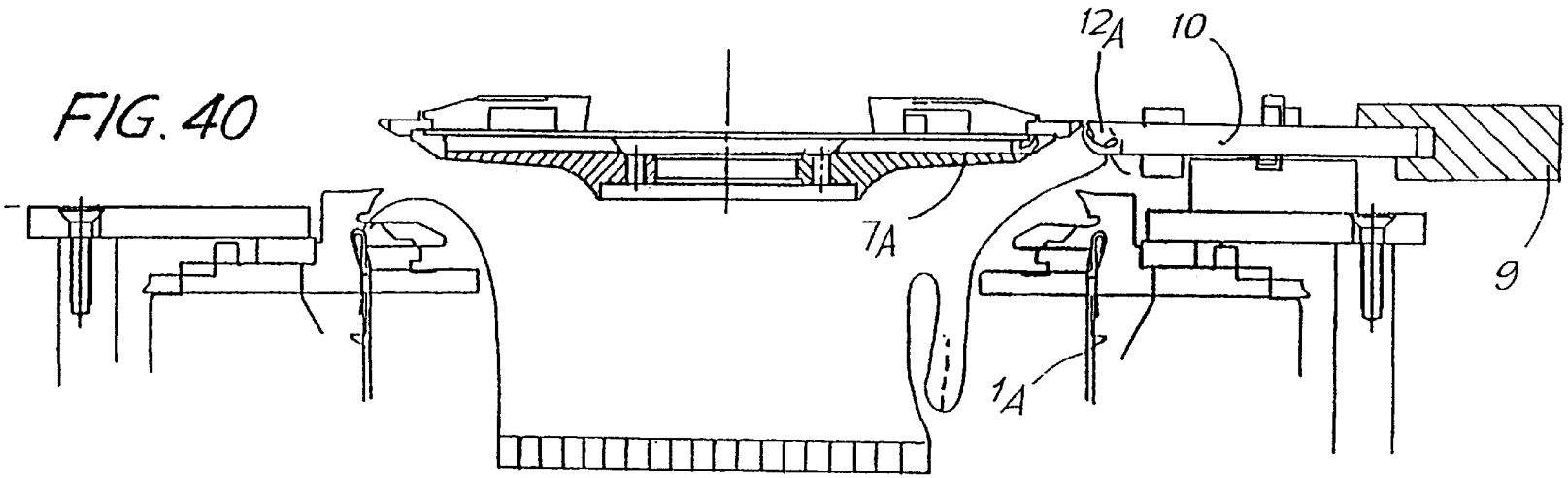
Figure 41:
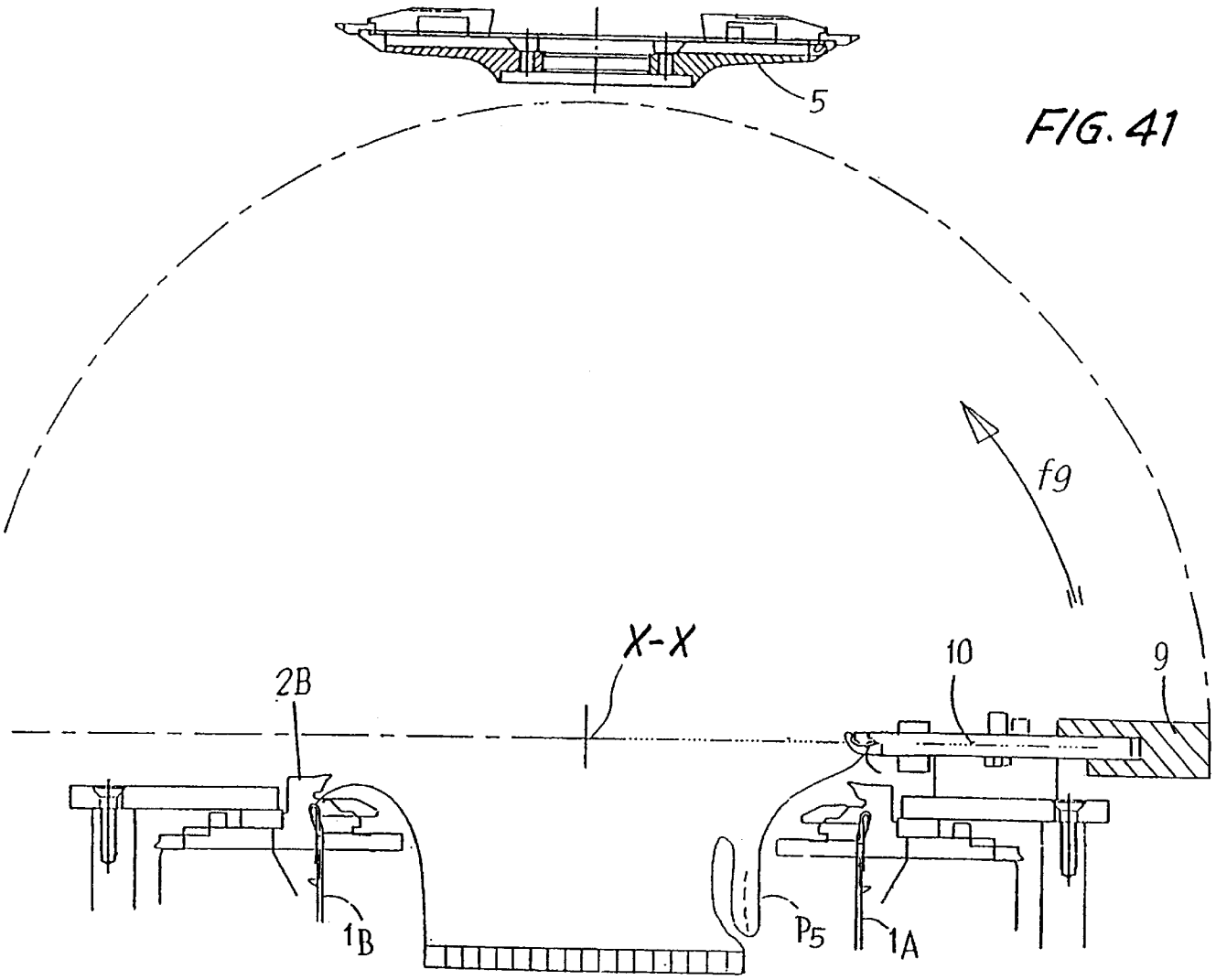
Figure 42:
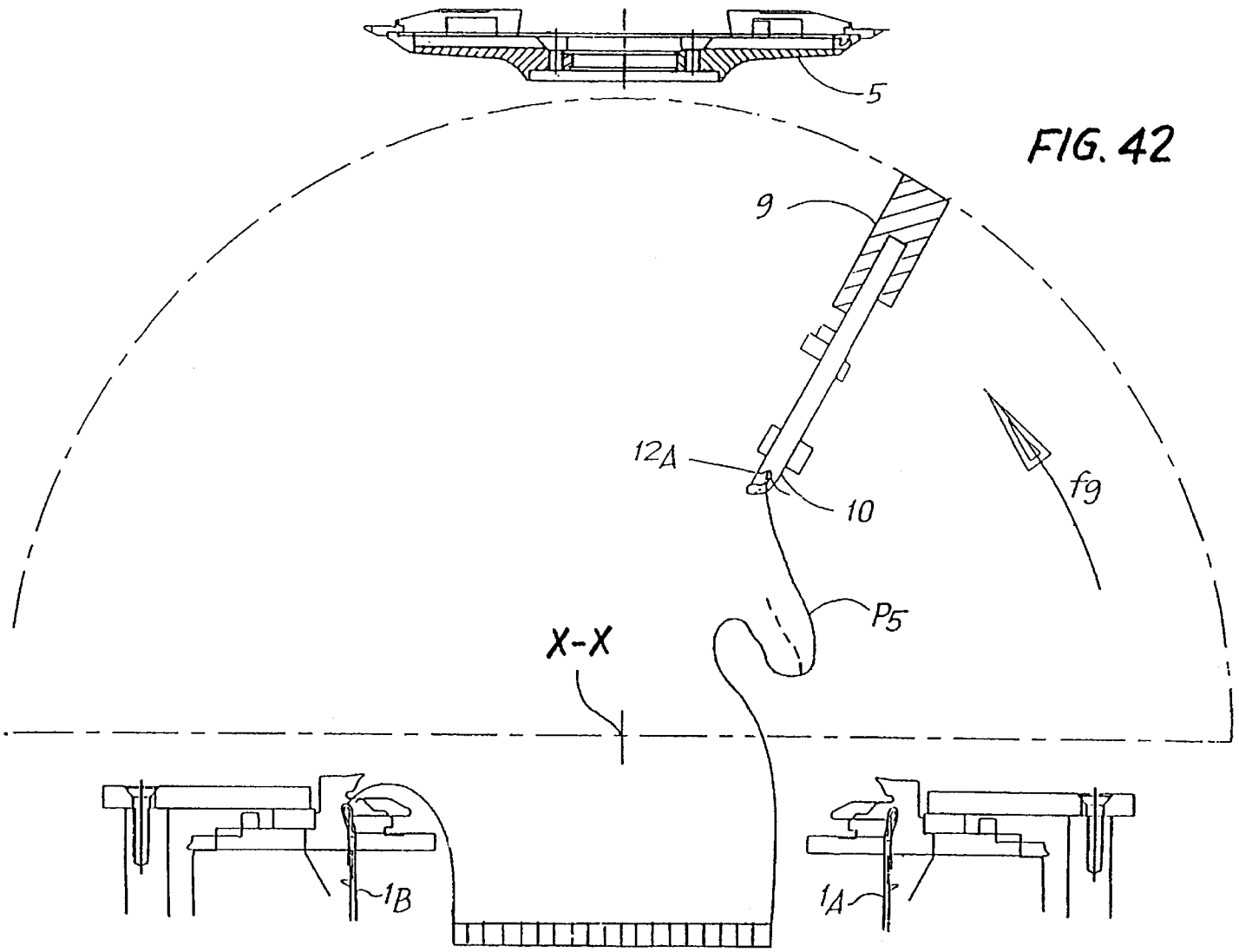
Figure 43:
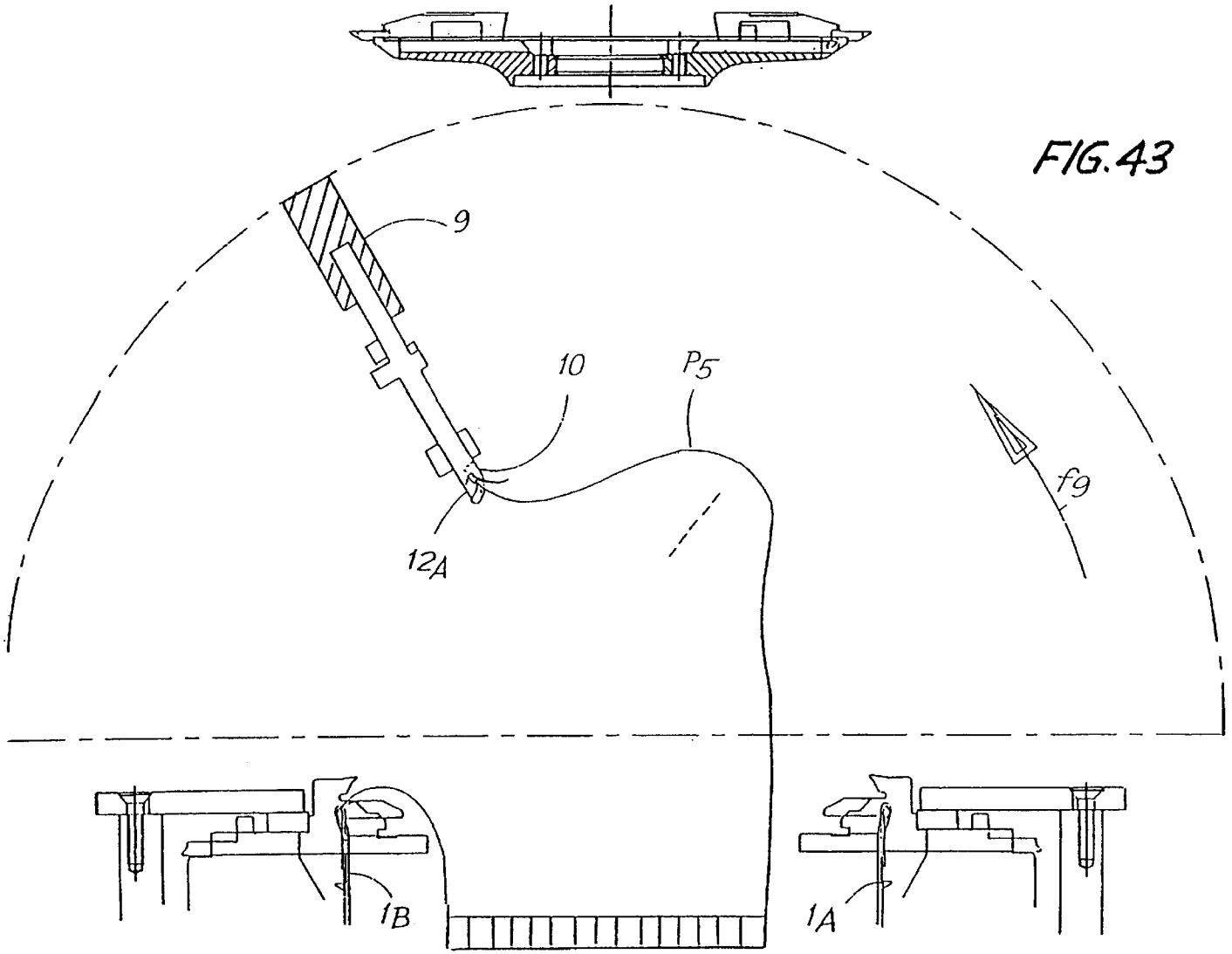
Figure 44:
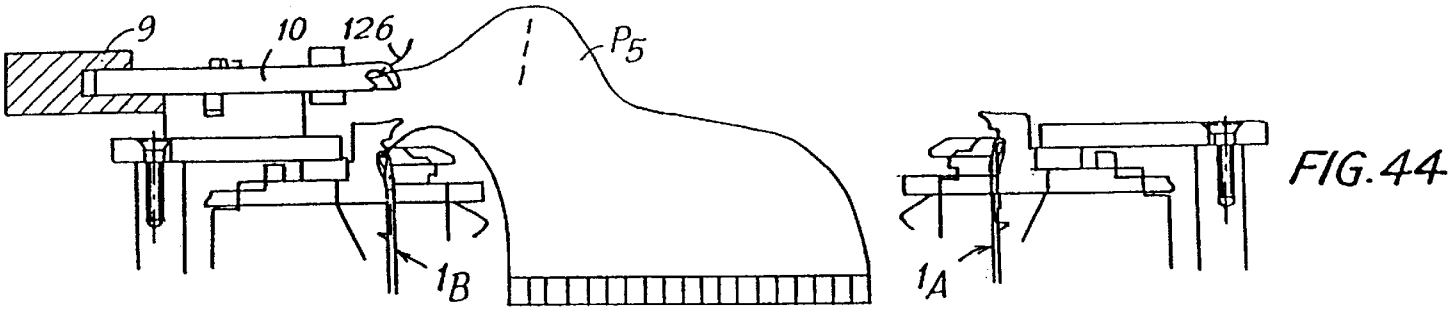
Figure 45:
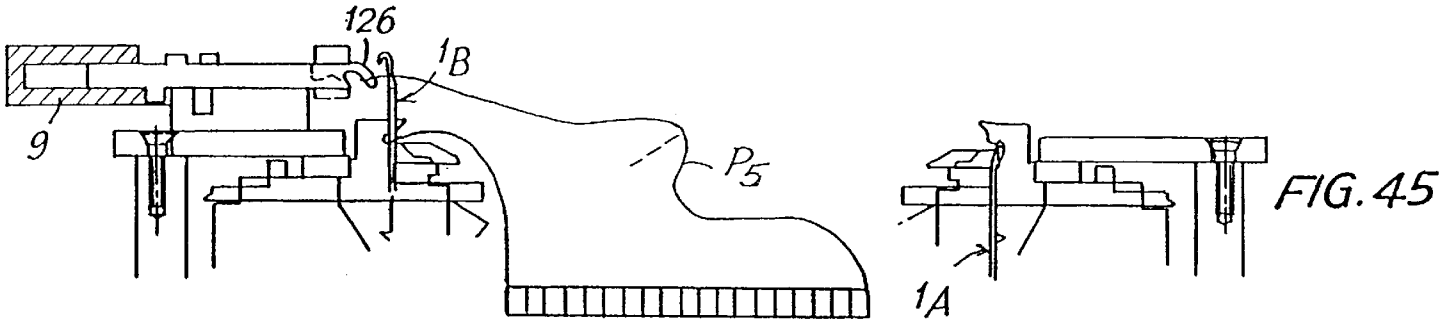
Figure 46:
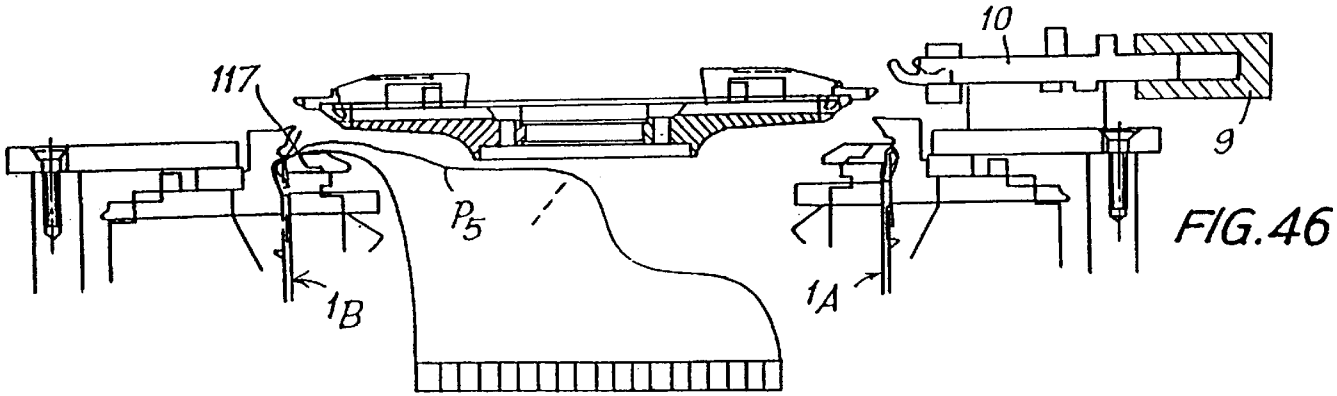

FIG. 32 indicates the forming of the tubular article T4 with formation of the more or less elastic initial edge BT. After having made the fabric T4 to the desired article length and when the toe is to be started, while the needles of the semicircle 1B are kept inactive and holding the tubular fabric T4, the needles 1A of the semicircle intended to form the toe fabric P5 are kept active forming this fabric P5 with reciprocating motion of the needle cylinder or with continuous motion and cutting of the threads at the ends of the courses and with drops and increases, as is conventional per se. After the phase illustrated in FIG. 32 the hooks 7A are pushed out (FIG. 34) to load them with a loop 116 from the arc A of needles 1A which have been making the fabric PS for the toe pouch (see especially FIG. 34A). After this (FIG. 35), a small lip of non-run fabric 126 is formed between the hooks 7A which are retracted and the needles 1A, which after forming this lip 126 release the fabric P5, which remains engaged on the hooks 7A (FIG. 36). The disc 5 is raised and the pick-up hooks begin to advance towards the centre (see FIG. 37) until they arrive (FIG. 38) over the needles while the hooks 7A are moved centrifugally over the pick-up hooks 10, so that as the disc 5 is lowered the edge of the fabric P5 is transferred to the pick-up hooks 10 (see FIG. 39); at this point the hooks 7A are retracted centrifugally, and the closing sliders 12 are advanced to form an eye with the crooked ends 10A of the hooks 10 (see FIG. 40), after which the disc 5 is raised to allow the half ring 9 to be rotated in the direction of arrow f9 about the diametrical axis X—X as in the previous case, to transfer the fabric P5 from the arc A of needles 1A to the arc B of needles 1B (FIGS. 41 to 43), finally reaching the position of FIG. 44 where the eyes formed by the pick-up hooks 10 and closing sliders 12 are above the needles 1B and around the outside of the needles 1B (FIGS. 44 and 45). As the needles 1B rise, they therefore pass through the edge of the fabric P5 and engage it on these needles 1B, which will then move back down capturing a yarn to form a small partial lip of stitches with which to close the toe, as seen in FIG. 46.

In a simplified embodiment the toe can be closed—at the end of the tubular fabric—without forming the pouch P5.

It will be understood that the drawing shows only an example by way of a practical demonstration of the invention, which latter may vary as regards shapes and arrangements without thereby departing from the scope of the concept on which the invention is based. Any reference numerals that may be present in the accompanying claims are for the purpose of facilitating the reading of the claims with reference to the description and drawing, and do not limit the scope of protection represented by the claims.

I claim:

1. Device for closing one end of a tubular knitted article on a same circular machine that produced the article, the device comprising:

a needle cylinder;

a disc having a semicircle of hooks and located coaxially with the cylinder;

a first semicircle of needles and an opposite second semicircle of needles, said semicircle of hooks being movable for ordered taking of stitch loops from the first semicircle of needles, which stitched loops are intended to be transferred to the opposite semicircle of needles;

a half ring, external to the needle cylinder, hinged at both ends about a diametrical axis (X—X) in a working area of the needles and in such a way that the half ring can rotate through 180°, rising and then falling;

a semicircle of pick-up hooks arranged in radial slots in said half ring with closing sliders for engaging initial loops of toe fabric formed by said needles of the first semicircle;

and means for controlling the hooks of the first semicircle and said pick-up hooks, and for moving the disc axially to transfer the loops from the hooks of the disc to the pick-up hooks, which transfer the loops they have received and bring them down over the needles of said opposite semicircle, which needles engage the toe fabric.

2. Device according to claim 1, wherein:

after said transfer from the hooks, said pick-up hooks are positioned on a semicircle of greater radius than that of the needles of said first semicircle to cause, said needles to poke through the fabric and engage the fabric.

3. Device according to claim 1, wherein:

after the transfer from the hooks, said pick-up hooks are positioned to present respective loops, which they have transferred, to the needles, which rise and engage them.

4. Device according to claim 1, wherein:

said disc of the hooks can be raised and lowered along an axis of the cylinder, and said hooks are movable radially to:

engage the loops of said first semicircle of needles;

allow formation of the toe fabric;

position the loops over the pick-up hooks and pass them to these; and move up in order to allow said half-ring to be thrown over.

5. Device according to claim 1, wherein:

said pick-up hooks and said closing sliders are shaped to cooperate in forming an eye in which to engage the loops, and the closing sliders are shaped with a shallow recess to allow the loop to be withdrawn by a centrifugal radial movement.

6. Device according to claim 1, wherein: each said pick-up hook is a pair, with the closing slider positioned between two hooks.

7. Device according to claim 6, wherein:

the pick-up hooks with respective said closing sliders are positioned behind every other said needle so as to form one loop every two said needles.

8. Device according to claim 6, wherein:

the pick-up hooks with respective said closing sliders are positioned behind each said needle, the pick-up hooks and the needles are so operated that needles in even-numbered positions and needles in odd-numbered positions act alternately in order to create loops corresponding to all the needles of the semicircle of needles that are forming the toe fabric.

9. Device according to claim 1, wherein:

operations of forming the toe fabric and closing are performed at a start of a production cycle.

10. Device according to claim 1, wherein:

operations of forming the toe fabric and closing the toe fabric are performed after the tubular article has been formed and include forming of a non-run draw-off lip.

11. Method for forming a closed toe at one end of a tubular article, the method comprising the steps of:

providing a circular knitting machine with a first and second semicircle of needles, hooks, and a half ring element including a plurality of pick-up hooks, said second semicircle of needles being opposite said first semicircle of needles;

knitting an initial toe-fabric with said first semicircle of needles, the toe fabric having loops positioned around an outside of said second semicircle of needles;

engaging said loops with said hooks of said needles of said first semicircle of needles;

transferring the loops from said hooks to said pick-up hooks by raising and throwing said half ring element over a diametrical axis in a working area of said needles;

raising said needles of said second semicircle to engage an edge of said toe fabric.

12. Method according to claim 11, characterized in that the toe fabric is made and closed before the tubular fabric is commenced.

13. Method according to claim 11, characterized in that the toe fabric is made and closed after the tubular fabric has been made.

14. Device for closing one end of a tubular knitted article on a circular machine that produced the tubular knitted article, the device comprising:

a needle cylinder;

a disc including a semicircle of hooks and located coaxially with said needle cylinder;

a first and second semicircle of needles, said semicircle of hooks being moveable for ordered taking of stitch loops from said first semicircle of needles, said stitch loops being transferrable to said second semicircle of needles;

a half ring external to said needle cylinder, hinged at both ends about a diametrical axis in a working area of said needles and rotatable through 180 degrees for rising and falling, said half ring defining a plurality of radial slots;

a semicircle of pick-up hooks arranged in said radial slots of said half ring, said semicircle of pick-up hooks including closing sliders for engaging initial loops of fabric formed by said needles of said first semicircle;

means for controlling the hooks and said pick-up hooks, and for moving said disc axially to transfer said loops said hooks of said disc to said pick-up hooks, and to then transfer the loops from said pick-up hooks over said needles of said second semicircle, said needles of said second semicircle engaging the fabric.

* * * * *